US008475989B2

(12) United States Patent
Takahashi et al.

(10) Patent No.: US 8,475,989 B2
(45) **Date of Patent: *Jul. 2, 2013**

(54) CARRIER, METHOD FOR PREPARING THE CARRIER, DEVELOPER USING THE CARRIER, DEVELOPER CONTAINER, AND IMAGE FORMING METHOD AND PROCESS CARTRIDGE USING THE DEVELOPER

(75) Inventors: Yutaka Takahashi, Yokohama (JP); Minoru Masuda, Numazu (JP); Kimitoshi Yamaguchi, Numazu (JP); Hisashi Nakajima, Numazu (JP); Koichi Sakata, Shizuoka-ken (JP); Hitoshi Iwatsuki, Numazu (JP); Saori Yamada, Numazu (JP); Toyoaki Tano, Numazu (JP); Mariko Takii, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 192 days.

This patent is subject to a terminal disclaimer.

(21) Appl. No.: 12/897,326

(22) Filed: Oct. 4, 2010

(65) Prior Publication Data

US 2011/0091802 A1 Apr. 21, 2011

(30) Foreign Application Priority Data

| | | |
|---|---|---|
| Oct. 15, 2009 | (JP) | 2009-238554 |
| Oct. 20, 2009 | (JP) | 2009-241702 |
| Mar. 11, 2010 | (JP) | 2010-054494 |
| Sep. 7, 2010 | (JP) | 2010-200242 |

(51) Int. Cl.
*G03G 9/00* (2006.01)

(52) U.S. Cl.
USPC ..... 430/111.35; 430/111.1; 430/111.3; 430/111.31; 430/123.4

(58) Field of Classification Search
USPC ..... 430/111.1, 111.3, 111.31, 111.35, 430/123.4
See application file for complete search history.

(56) References Cited

U.S. PATENT DOCUMENTS

| | | | |
|---|---|---|---|
| 4,954,409 | A | 9/1990 | Aoki et al. |
| 5,441,839 | A | 8/1995 | Ishikawa et al. |

(Continued)

FOREIGN PATENT DOCUMENTS

| | | | |
|---|---|---|---|
| CN | 101351747 | A | 1/2009 |
| JP | 54-21730 | | 2/1979 |

(Continued)

OTHER PUBLICATIONS

Office Action issued Oct. 15, 2012 in Chinese Patent Application No. 201010510269.6.

(Continued)

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

The carrier is used for a two-component developer for developing an electrostatic latent image, and includes a particulate magnetic core material; and a cover layer located on a surface of the core material and including a crosslinked material and barium sulfate. The cover layer is formed by applying a coating medium including barium sulfate, a copolymer including a unit (A) having a specific acrylic siloxane structure including a tris(trialkylsiloxy)silanyl group and a unit (B) having a specific acrylic silicone structure having a crosslinking ability, and a condensation reaction catalyst, heating the applied medium to a temperature of from 100° C. to 230° C. so that the copolymer is hydrolyzed to produce a material having a silanol group, and the material and the catalyst are subjected to a condensation reaction to form the crosslinked material.

15 Claims, 2 Drawing Sheets

U.S. PATENT DOCUMENTS

| | | | | |
|---|---|---|---|---|
| 5,468,825 | A | 11/1995 | Takarada et al. | |
| 5,576,134 | A | 11/1996 | Ogawa et al. | |
| 5,652,079 | A * | 7/1997 | Mochizuki et al. | 430/111.1 |
| 5,731,120 | A | 3/1998 | Tanigami et al. | |
| 7,192,679 | B2 | 3/2007 | Yamaguchi et al. | |
| 7,381,513 | B2 | 6/2008 | Suzuki et al. | |
| 7,553,598 | B2 | 6/2009 | Suzuki et al. | |
| 7,592,116 | B2 | 9/2009 | Suzuki et al. | |
| 8,211,610 | B2 * | 7/2012 | Yamaguchi et al. | 430/111.35 |
| 2006/0093943 | A1 | 5/2006 | Shu et al. | |
| 2006/0210905 | A1 | 9/2006 | Imahashi et al. | |
| 2007/0048652 | A1 | 3/2007 | Imahashi et al. | |
| 2007/0141502 | A1 | 6/2007 | Aga et al. | |
| 2007/0243482 | A1 | 10/2007 | Yamaguchi et al. | |
| 2008/0063969 | A1 | 3/2008 | Yamaguchi et al. | |
| 2008/0096121 | A1 | 4/2008 | Iwatsuki et al. | |
| 2008/0152393 | A1 | 6/2008 | Nagayama et al. | |
| 2008/0213684 | A1 | 9/2008 | Nagayama et al. | |
| 2008/0227004 | A1 | 9/2008 | Yamaguchi et al. | |
| 2009/0041510 | A1 | 2/2009 | Imahashi et al. | |
| 2009/0074450 | A1 | 3/2009 | Nagayama et al. | |
| 2009/0092920 | A1 | 4/2009 | Nagayama et al. | |
| 2010/0233613 | A1 | 9/2010 | Masuda et al. | |
| 2010/0239975 | A1 | 9/2010 | Yamaguchi et al. | |
| 2011/0086307 | A1 * | 4/2011 | Nakajima et al. | 430/111.3 |

FOREIGN PATENT DOCUMENTS

| | | |
|---|---|---|
| JP | 55-127569 | 10/1980 |
| JP | 55-157751 | 12/1980 |
| JP | 56-140358 | 11/1981 |
| JP | 57-96355 | 6/1982 |
| JP | 57-96356 | 6/1982 |
| JP | 58-117555 | 7/1983 |
| JP | 58-207054 | 12/1983 |
| JP | 59-232362 | 12/1984 |
| JP | 61-110161 | 5/1986 |
| JP | 62-273576 | 11/1987 |
| JP | 6-222621 | 8/1994 |
| JP | 6-301245 | 10/1994 |
| JP | 7-261465 | 10/1995 |
| JP | 8-305090 | 11/1996 |
| JP | 2001-92189 | 4/2001 |
| JP | 2006-337828 | 12/2006 |
| JP | 2007-286078 | 11/2007 |
| WO | WO 2010/055933 A1 | 5/2010 |

OTHER PUBLICATIONS

U.S. Appl. No. 12/896,276, filed Oct. 1, 2010, Nakajima, et al.
U.S. Appl. No. 12/879,722, filed Sep. 10, 2010, Iwatsuki, et al.

* cited by examiner

CARRIER, METHOD FOR PREPARING THE CARRIER, DEVELOPER USING THE CARRIER, DEVELOPER CONTAINER, AND IMAGE FORMING METHOD AND PROCESS CARTRIDGE USING THE DEVELOPER

BACKGROUND OF THE INVENTION

1. Field of the Invention

The present invention relates to a carrier for use in a two-component developer developing an electrostatic image, to a method for preparing the carrier, and a two-component developer using the carrier and a toner. In addition, the present invention also relates to a developer container, and an image forming method and a process cartridge using the two-component developer.

2. Description of the Related Art

Electrophotographic image forming methods typically include the following processes:

(1) Forming an electrostatic latent image on an image bearing member such as a photoreceptor;

(2) Developing the electrostatic latent image with a developer including a toner to form a toner image on the image bearing member;

(3) Transferring the toner image onto a recording material;

(4) Fixing the toner image on the recording material, resulting in formation of an output image.

Recently, in the field of electrophotography, transition is rapidly being made from monochrome imaging to full-color imaging, and the market for full-color imaging is rapidly expanding.

In full-color imaging, all the color images are formed by forming primary color toner images using four color toners, i.e., yellow, magenta, cyan and black toners, while forming secondary color toner images by overlaying two or more of the primary color toner images. Therefore, in order to prepare a full-color image having a good combination of color reproducibility and clearness, the fixed color toner image preferably has a smooth surface to reduce light scattering at the surface. For this reason, color images produced by conventional full-color image forming apparatus typically have a relatively high glossiness of from 10% to 50%.

With respect to the image fixing method, contact heat fixing methods in which a heated fixing member such as a heat roller or a belt is contacted with a toner image upon application of pressure thereto are widely used. Such contact heat fixing methods have advantages of fixing a toner image at a high speed and a high heat efficiency while imparting a good combination of glossiness and transparency to the toner image. However, the contact heat fixing methods have a drawback in that they often cause an offset problem, in which apart of a toner image is adhered to a fixing member, and the adhered toner is transferred again to the image or another image, resulting in formation of an abnormal image, because the toner image is contacted with the fixing member upon application of heat and pressure to be melted.

In attempting to prevent occurrence of the offset problem, typically fixing methods are used in which a fixing roller having a surface made of a material having good releasability such as silicone rubbers and fluorine-containing resins is used while applying a toner adhesion preventing agent such as silicone oils to the surface of the fixing roller. Although the fixing methods are effective in preventing occurrence of the offset problem, the methods have a drawback in that, since an oil applicator has to be provided, the fixing device becomes unacceptably large. Therefore, recent monochrome image forming apparatuses tend to use toner having a relatively high melt viscoelasticity and including a release agent in combination with an oil-less fixing device or an oil micro-coating fixing device, in which a small amount of oil is applied to a fixing member.

Similarly, oil-less fixing methods are often used for full-color image forming apparatuses to miniaturize the fixing devices thereof and simplify the configuration. However, since full-color image forming apparatuses preferably produce glossy images as mentioned above, color toners used therefor preferably have a lower viscoelasticity than toners used for monochrome image forming apparatuses, thereby increasing the chance of occurrence of the offset problem. Therefore, it is difficult for full-color image forming apparatuses to use an oil-less fixing device.

In addition, toner including a release agent has drawbacks in that transferability of the toner to a recording material deteriorates because of having high adhesiveness to the surface of carrier, and a toner filming problem in that a film of toner is formed on the surface of the carrier used in combination of the toner, resulting in deterioration of the charging ability and durability (life) of the carrier On the other hand, coated carriers in which a resin having a low surface energy such as fluorine-containing resins and silicone resins is uniformly applied on a core material thereof are provided in order to prolong the life thereof, i.e., to prevent occurrence of the toner filming problem and other problems such that the surface of the carriers is oxidized, the moisture sensitivity of the carriers deteriorates, the carriers are adhered to image bearing members, and the carriers damage and abrade the surface of image bearing members, and to control the polarity and quantity of charge of the carriers.

Specific examples of the coated carriers having a surface coated with a resin having a low surface energy include a carrier having a cover layer formed by using a room temperature crosslinking silicone resin and a positively chargeable nitrogen-containing resin; a carrier having a cover layer formed of a material including at least a modified silicone resin; a carrier having a cover layer formed by using a room temperature crosslinking silicone resin and a styrene-acrylic resin; carriers having multiple cover layers formed by using silicone resins, wherein the cover layers may have poor adhesiveness with each other; a carrier having a cover layer including a silicone resin and silicon carbide; a positively chargeable carrier having a cover layer formed of a material having a critical surface tension of not greater than 20 dyne/cm; and a developer consisting of a carrier having a cover layer formed by using a coating agent including a fluorinated alkylacrylate, and a toner including chromium-containing azo dye.

Moreover, in attempting to prevent occurrence of a spent toner problem, in which spent toner is adhered to the surface of a carrier, resulting in deterioration of the charging ability of the carrier, there are proposals for carriers having a cover layer including a particulate inorganic material such as silica so that the spent toner adhered to the carrier is abraded by the particulate inorganic material. However, since the silica used for the cover layer are spherical, the abrasion effect is slight, and in addition the silica included in the cover layer is easily released therefrom under heavy stress applied to the carrier, for example, in a thin developer layer developing method in which a thin developer layer is formed on a developer bearing member to develop an electrostatic latent image. Therefore, the carrier cannot maintain the abrasion effect for a long period of time, thereby degrading the charging ability of the carrier and decreasing the charge quantity of the toner, resulting in occurrence of a toner scattering problem in that toner scatters around a developing device, thereby contaminating parts of the developing device and the image forming apparatus, and a background development problem in that the background of an image is soiled with toner particles having an insufficient charge quantity.

Further, in order to produce high quality images, the diameter of the particles that constitute the toner is being specification reduced. When images are formed at a high-speed using such small toner particles, the spent toner problem is easily caused. In this regard, when a wax is included in the toner as a release agent, the amount of spent toner adhered to the carrier seriously increases, thereby degrading the charging ability of the carrier and decreasing the charge quantity of the toner, resulting in occurrence of the toner scattering problem and the background development problem.

In full-color image formation systems, when spent toner is adhered to the surface of a carrier, or the cover layer of a carrier is abraded or released, the resistance of the carrier and the amount of toner born by the surface of the carrier change, resulting in a change of image density (particularly image density of highlighted portions). In addition, when a filler included in a cover layer of a carrier is released therefrom due to abrasion of the cover layer and mixed with a color toner used in combination therewith, the color of the color toner (particularly yellow toner) is changed, resulting in deterioration of the color reproducibility of images.

For these reasons, the inventors recognized that there is a need for a carrier which can produce high quality images in combination with toner without causing the above-mentioned problems such as the spent toner problem, the toner scattering problem, and the background development problem.

SUMMARY

This patent specification describes a novel carrier for use in a two-component developer for developing an electrostatic latent image, one embodiment of which includes a particulate magnetic core material, and a cover layer located on a surface of the core material and including a crosslinked material and barium sulfate. The cover layer is formed by applying a coating medium including barium sulfate, a copolymer including a unit (A) having the below-mentioned formula (1) and a unit (B) having the below-mentioned formula (2), and a condensation reaction catalyst to the surface of the carrier, and heating the applied medium to a temperature of from 100° C. to 230° C. so that the copolymer is hydrolyzed to produce a material having a silanol group, and the material and the condensation reaction catalyst are subjected to a condensation reaction to form the crosslinked material.

(1)

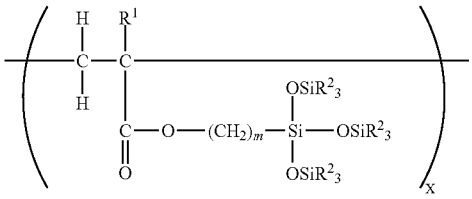

, and

-continued (2)

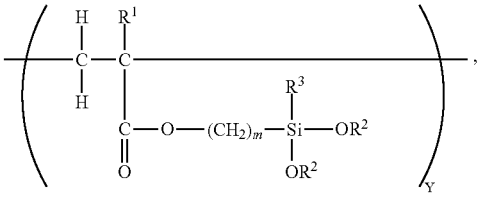

wherein $R^1$ represents a hydrogen atom or a methyl group, m is an integer of from 1 to 8, $(CH_2)_m$ represents an alkylene group having 1 to 8 carbon atoms, $R^2$ represents an alkyl group having 1 to 4 carbon atoms, $R^3$ represents an alkyl group having 1 to 8 carbon atoms or an alkoxyl group having 1 to 4 carbon atoms, and X and Y respectively represent molar ratios of the units A and B and each of X and Y is from 10% by mole to 90% by mole.

In addition, the cover layer includes Ba and Si at anatomic ratio of from 0.01 to 0.08, which is determined by X-ray photoelectron spectroscopy (XPS).

This patent specification further describes a novel two-component developer for developing an electrostatic latent image, one embodiment of which includes a toner and the above-mentioned carrier.

This patent specification further describes a novel carrier forming method, one embodiment of which includes applying a coating medium including barium sulfate, a copolymer including a unit (A) having the above-mentioned formula (1) and a unit (B) having the above-mentioned formula (2), and a condensation reaction catalyst to a particulate core material; and heating the applied medium to a temperature of from 100° C. to 230° C. so that the copolymer is hydrolyzed to produce a material having a silanol group, and the material and the condensation reaction catalyst are subjected to a condensation reaction to form a cover layer including a crosslinked material and barium sulfate on a surface of the particulate core material.

This patent specification further describes a novel developer container, one embodiment of which contains the above-mentioned two-component developer.

This patent specification further describes a novel image forming method, one embodiment of which includes forming an electrostatic latent image on an image bearing member; developing the electrostatic latent image with the above-mentioned two-component developer to form a toner image on the image bearing member; transferring the toner image to a recording material; and fixing the toner image to the recording material.

This patent specification further describes a novel process cartridge, one embodiment of which includes at least an image bearing member configured to bear an electrostatic latent image; and a developing device configured to develop the electrostatic latent image with the above-mentioned developer to form a toner image on the image bearing member, wherein the image bearing member and the developing device are integrated.

BRIEF DESCRIPTION OF THE DRAWINGS

Amore complete appreciation of the aspects of the invention and many of the attendant advantage thereof will be readily obtained as the same better understood by reference to the following detailed description when considered in connection with the accompanying drawings, wherein.

DESCRIPTION OF THE PREFERRED EMBODIMENTS

Figure 1:
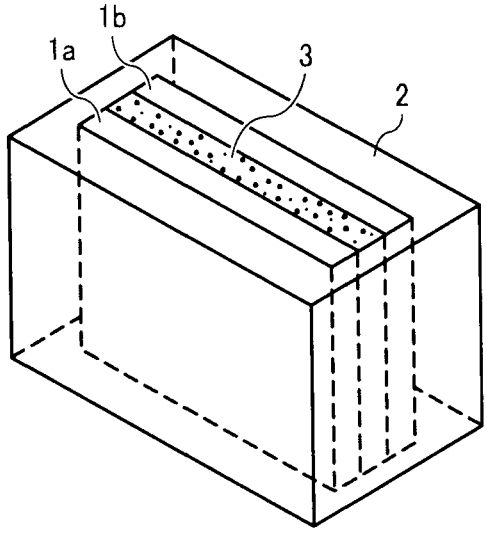
FIG. 1 is a schematic view illustrating a cell used for measuring the volume resistivity of a carrier.

Initially, the carrier of the present invention will be described.

The carrier of the present invention includes a particulate magnetic core material (i.e., carrier material) and a cover layer (i.e., carrier cover layer) formed on the surface of the core material.

The cover layer includes at least a crosslinked material and barium sulfate, and optionally includes other components. The crosslinked material is prepared by hydrolyzing a copolymer including a unit (A) having the below-mentioned formula (1) and a unit (B) having the below-mentioned formula (2) to produce a material having a silanol group, and then subjecting the material to a condensation reaction using a condensation reaction catalyst.

(1)

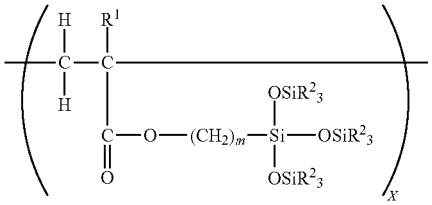

, and (2)

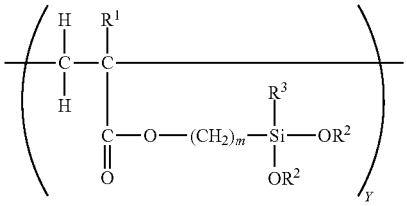

,

In formulae (1) and (2), $R^1$ represents a hydrogen atom or a methyl group, m is an integer of from 1 to 8, $(CH_2)_m$ represents an alkylene group having 1 to 8 carbon atoms, $R^2$ represents an alkyl group having 1 to 4 carbon atoms, $R^3$ represents an alkyl group having 1 to 8 carbon atoms or an alkoxyl group having 1 to 4 carbon atoms, and X and Y respectively represent molar ratios of the units A and B and each of X and Y is from 10% by mole to 90% by mole.

Specific examples of the alkylene groups for use as the group $(CH_2)_m$ include methylene, ethylene, propylene and butylene groups, but are not limited thereto. Specific examples of the alkyl groups having 1 to 4 carbon atoms for use as the group $R^2$ include methyl, ethyl, propyl, isopropyl and butyl groups, but are not limited thereto. Specific examples of the alkyl groups having 1 to 8 carbon atoms for use as the group $R^3$ include methyl, ethyl, propyl, isopropyl and butyl groups, but are not limited thereto. Specific examples of the alkoxyl groups having 1 to 4 carbon atoms for use as the group $R^3$ include methoxy, ethoxy, propoxy and butoxy groups, but are not limited thereto.

The copolymer used for preparing the crosslinked material included in the cover layer has the following formula (3):

(3)

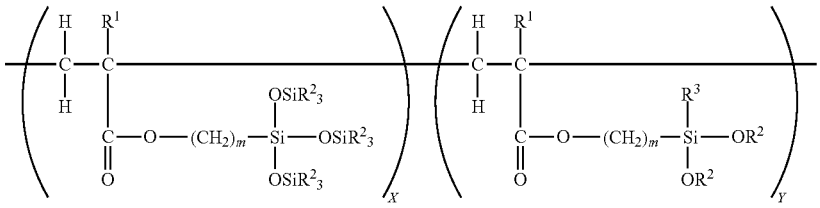

, wherein $R^1$, $R^2$, $R^3$, $(CH_2)_m$, X and Y are defined above.

The unit (A) has an atom group, i.e., a tris(trialkylsiloxy) silane group including plural alkyl groups in the side chain thereof. When the molar ratio X of the unit A increases, the surface energy of the copolymer decreases, and thereby the amount of resin and wax components of the toner adhered to the surface of the carrier can be decreased. The molar ratio X is from 10% by mole to 90% by mole, and preferably from 30% by mole to 70% by mole. When the molar ratio X is lower than 10% by mole, the above-mentioned effect can be hardly produced, i.e., resin and wax components of the toner are easily adhered to the surface of the carrier. By contrast, when the molar ratio X is higher than 90% by mole, the ratio Y of the unit (B) decreases, thereby insufficiently crosslinking the copolymer in the heat treatment, resulting in occurrence of problems in that toughness of the cover layer and adhesion of the cover layer to the core material deteriorate, resulting in deterioration of the durability of the cover layer.

Specific examples of monomers capable of forming the unit (A) include tris(trialkylsiloxy)silane compounds having the following formulae.

$CH_2{=}CMe{-}COO{-}C_3H_6{-}Si(OSiMe_3)_3$ $CH_2{=}CH{-}COO{-}C_3H_6{-}Si(OSiMe_3)_3$ $CH_2{=}CMe{-}COO{-}C_4H_8{-}Si(OSiMe_3)_3$ $CH_2{=}CMe{-}COO{-}C_3H_6{-}Si(OSiEt_3)_3$ $CH_2{=}CH{-}COO{-}C_3H_6{-}Si(OSiEt_3)_3$ $CH_2{=}CMe{-}COO{-}C_4H_8{-}Si(OSiEt_3)_3$ $CH_2{=}CMe{-}COO{-}C_3H_6{-}Si(OSiPr_3)_3$ $CH_2{=}CH{-}COO{-}C_3H_6{-}Si(OSiPr_3)_3$ $CH_2{=}CMe{-}COO{-}C_4H_8{-}Si(OSiPr_3)_3$

In the formulae above, Me represents a methyl group, Et represents an ethyl group, and Pr represents a propyl group.

The method for preparing a monomer for use informing the unit (A) is not particularly limited. For example, a method in which a tris(trialkylsiloxane)silane is reacted with allyl acrylate or allyl methacrylate in the presence of a platinum catalyst; a method disclosed in published unexamined Japanese patent applications No JP-H11-217389-A in which a methacryloyloxyalkyltrialkoxysilane is reacted with a hexaalkyldisiloxane in the presence of a carboxylic acid and an acid catalyst; etc. can be used.

The unit (B) functions as a crosslinking component. The molar ratio Y of the unit (B) is from 10% by mole to 90% by mole, and preferably from 30% by mole to 70% by mole. When the molar ratio Y is lower than 10% by mole, the resultant cover layer tends to have insufficient toughness. By contrast, when the molar ratio Y is higher than 90% by mole, the resultant cover layer becomes hard and brittle, and thereby the cover layer is easily abraded. In addition, the resultant cover layer tends to exhibit poor stability to withstand environmental conditions. The reason therefor is considered to be that a number of silanol groups remain in the crosslinked material, thereby degrading the environmental stability of the cover layer (i.e., the properties of the cover layer seriously change depending on ambient humidity).

Specific examples of monomers for use in preparing the unit (B) include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane, 3-acryloxypropyltri(isopropoxy)silane, etc.

In order that the cover layer have good flexibility, and the resin of the cover layer have good adhesion to the core material and a particulate electroconductive material included in the cover layer, it is preferable that the copolymer have a unit (C) having the following formula (4):

FORMULA 4

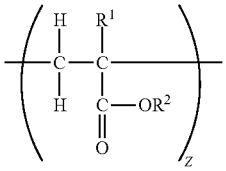

wherein $R^1$ represents a hydrogen atom or a methyl group, $R^2$ represents an alkyl group having 1 to 4 carbon atoms, and Z represents the molar ratio of the unit.

Namely, the copolymer preferably has the following formula (5):

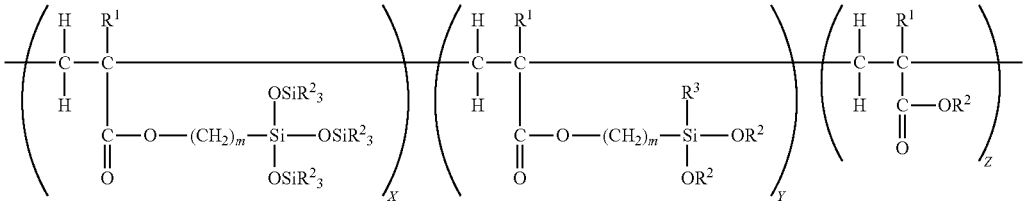

(5)

wherein $R^1$ represents a hydrogen atom or a methyl group, m is an integer of from 1 to 8, $(CH_2)_m$ represents an alkylene group having 1 to 8 carbon atoms, $R^2$ represents an alkyl group having 1 to 4 carbon atoms, $R^3$ represents an alkyl group having 1 to 8 carbon atoms or an alkoxyl group having 1 to 4 carbon atoms, and X, Y and Z respectively represent molar ratios of the units A, B and C, and each of X and Y is from 10% by mole to 40% by mole and Z is from 30% by mole to 80% by mole, wherein 60% by mole<Y+Z<90% by mole.

The molar ratio Z is preferably from 35% by mole to 75% by mole, and (Y+Z) is preferably from 70% by mole to 85% by mole.

When the molar ratio Z is greater than 80% by mole, any one or both of X and Y become less than 10% by mole, it becomes difficult to impart a good combination of water-shedding property, hardness and flexibility (i.e., abrasion resistance) to the cover layer.

Specific examples of the monomers for forming the unit (C) include acrylates and methacylates such as methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino)ethyl methacrylate, 2-(diethylamino) ethyl acrylate, etc. Among these monomers, alkyl methacrylates are preferable, and methyl methacrylate is more preferable. These monomers can be used alone or in combination for forming the unit (C).

A technique for imparting good durability to a film by crosslinking the film is disclosed, for example, in Japanese patent No. 3691115 (JP-3691115-B). It is disclosed that the surface of a particulate magnetic material is covered with a thermally crosslinked resin, which is prepared by crosslinking a copolymer obtained from an organopolysiloxane having a vinyl group at an end thereof and a radically polymerizable monomer having at least one functional group selected from the group consisting of hydroxyl, amino, amide and imide groups using an isocyanate compound, to prepare a coated carrier for use in electrophotographic developers. However, as a result of the present inventors' investigation, the cover layer does not have good durability, so that a peeling/abrasion problem in that the cover layer of the coated carrier is peeled or abraded is easily caused.

The reason why such a cover layer does not have good durability is not yet clear, but is likely to be as follows. When such a copolymer as mentioned above is crosslinked by using an isocyanate compound, the number of functional groups capable of reacting with the isocyanate compound per a unit weight of the copolymer is small, and thereby a film having a dense two- or three-dimensional network cannot be formed. Therefore, the resultant carrier easily causes the peeling/abrasion problem, i.e., the carrier has insufficient durability.

When the peeling/abrasion problem is caused, the electric resistance of the carrier deteriorates, thereby degrading the quality of images produced by a developer using the carrier. In addition, a carrier adhesion problem in that carrier particles in a developer adhere to an electrostatic latent image is caused. Further, when the peeling/abrasion problem is caused, the fluidity of the developer deteriorates, thereby causing a problem in that the developer cannot be properly attracted to a developer bearing member configured to bear the developer to develop an electrostatic latent image, resulting in decrease of image density. In addition, in this case the toner concentration in the developer increases, and thereby the background development problem and/or the toner scattering problem are easily caused.

By contrast, in the cover film of the carrier of the present invention, the number of crosslinkable di- or tri-functional groups included in a unit weight of the copolymer having formula (3) per unit weight thereof is twice or three times that in the copolymer used for the carrier disclosed in JP-3691115-B. In addition, since the copolymer having formula (3) is further subjected to a condensation polymerization to be crosslinked, the resultant cover layer has a good combination of toughness and abrasion resistance, resulting in improvement of the durability of the carrier.

Further, the siloxane bond constituting the crosslinked resin of the cover layer of the carrier of the present invention has higher bond energy than the crosslinked resin of the carrier of JP-3691115-B and which is prepared by using an isocyanate compound. Therefore, the cover layer of the carrier of the present invention is stable even when suffering thermal stresses. Namely, the cover layer can maintain good stability over a long period of time.

Next, the catalyst used for hydrolyzing a copolymer having at least one of units (A) and (B) to form a material having a silanol group, and then subjecting the material to condensation polymerization (condensation reaction) will be described.

In this regard, the crosslinking reaction of the copolymer is performed as follows. Specifically, when a group —Si—OR group in the unit (B) is reacted with water, a silanol group, —Si—OH, is formed. The thus-formed silanol group in one of the unit (B) is reacted with another silanol group in another of the unit (B), resulting in formation of a siloxane bond (—Si—O—Si—). Thus, the copolymer is crosslinked.

Suitable materials for use as the catalyst include titanium-containing catalysts, tin-containing catalysts, zirconium-containing catalysts, aluminum-containing catalysts, etc. Among these catalysts, titanium-containing catalysts are preferable.

Specific examples of the titanium-containing catalysts include acetylacetonate complexes of titanium, alkylacetoacetato complexes of titanium, salicylaldehydato complexes of titanium, etc. Among these titanium-containing catalysts, titanium diisopropoxybis(ethylacetoacetate) is preferable. This is because the catalyst has good effect of accelerating a condensation reaction of a material having a silanol group while being hardly deactivated.

Titanium diisopropoxybis(ethylacetoacetate) has the following formula (6):

$$Ti(O\text{-iso-}C_3H_7)_2(C_6H_9O_3)_2 \quad (6).$$

The cover layer of the carrier of the present invention includes barium sulfate (i.e., a compound including barium sulfate) to satisfactorily charge toner used in combination with the carrier and to prevent occurrence of the spent toner problem. This is because barium sulfate is relatively hard compared to resins used for the cover layer, and therefore external additives and resins of the toner adhered to the surface of a carrier particle can be easily removed therefrom by being abraded by barium sulfate on other carrier particles. Therefore, the carrier of the present invention can maintain good charging ability even after images having a high image area ratio are produced over a long period of time.

In addition, including barium sulfate in the cover layer produces another effect. Specifically, when images having a low image area ratio are produced over a long period of time (i.e., a developing operation is repeated while only a small amount of supplementary toner is supplied), the cover layer tends to be abraded, resulting in exposure of the core material of the carrier, i.e., decrease of the resistance of the carrier, thereby causing a carrier adhesion problem such that carrier particles adhered to electrostatic latent images, resulting in formation of images having white spots. By including barium sulfate in the cover layer, the mechanical strength of the cover layer is improved, i.e., the cover layer has good abrasion resistance. Therefore, even when a developing operation is repeated while only a small amount of supplementary toner is supplied, the cover layer is hardly abraded. Thus, the carrier having a cover layer including barium sulfate has much longer life than other carriers having a cover layer consisting of a resin.

In this regard, the atomic ratio Ba/Si of the barium content (Ba) to the silicon content (Si) in the carrier, which is determined by X-ray photoelectron spectroscopy (XPS), is from 0.01 to 0.08, preferably from 0.03 to 0.08. When the atomic ratio Ba/Si is less than 0.01, the carrier cannot have sufficient charging ability, thereby insufficiently charging toner, resulting in occurrence of the background development problem and the toner scattering problem. In addition, the cover layer is easily abraded, resulting in occurrence of the carrier adhesion problem.

By contrast, when the atomic ratio Ba/Si is greater than 0.08, the carrier excessively charges toner, and therefore the developer has insufficient developing ability. In addition, since the added amount of barium sulfate is too large, barium sulfate cannot be satisfactorily dispersed in a cover layer coating medium, resulting in formation of a cover layer in which barium sulfate is agglomerated. Therefore, barium sulfate is easily released from the resultant cover layer, resulting in abrasion of the cover layer, thereby causing the background development problem and the toner scattering problem.

Thus, the atomic ratio Ba/Si is preferably from 0.03 to 0.08. This is because when images having a high image area ratio are produced over a long period of time, for example, in commercial printing, the toner used in combination with the carrier is often charged unsatisfactorily when the ratio is less than 0.03.

The atomic ratio of Ba to all the elements detected by XPS is not limited, but is preferably from 0.2 atomic percent (number basis) to 1.2 atomic percent (number basis). When the ratio is less than 0.2 atomic percent, the resultant carrier often has insufficient charging ability, thereby easily causing the background development problem and the toner scattering problem. By contrast, when the ratio is greater than 1.2 atomic percent, the resultant carrier often imparts an excessive charge to toner, resulting in deterioration of the developing property of the toner.

In order to adjust the atomic ratio Ba/Si, it is preferable to adjust the amount of barium sulfate added to the cover layer.

The amount of barium sulfate included in the cover layer is preferably 2 parts by weight to 12 parts by weight, more preferably from 4 parts by weight to 10 parts by weight, and even more preferably from 6 parts by weight to 10 parts by weight, per 100 parts by weight of a silicone resin having formula (3) and included in the cover layer.

When the amount of barium sulfate is less than 2 parts by weight, the carrier has insufficient charging ability, resulting in occurrence of the background development problem and the toner scattering problem. By contrast, when the amount of barium sulfate is greater than 12 parts by weight, the resultant cover layer becomes brittle, and therefore the cover layer is easily abraded or released.

In this regard, the ratio of barium sulfate to a silicone resin in the cover layer is lower than the weight ratio of a barium sulfate compound to the silicone resin in a coating medium because all of barium sulfate particles present in the coating medium is not necessarily included in the resultant cover layer. In addition, when a barium sulfate compound, in which barium sulfate is covered with another material such as tin oxide, is used, the ratio of barium sulfate to a silicone resin in the cover layer further decreases.

It is preferable to finely disperse barium sulfate in a cover layer coating liquid so that barium sulfate dispersed in the cover layer has a large surface area, and the ratio (B/C) of the surface area (B) of barium sulfate to the surface area (C) of the cover layer increases. In addition, since the mechanical strength of the cover layer also increases, the resistance of the carrier hardly changes even when a large stress is applied to the carrier.

In this application, the atomic ratio Ba/Si is determined by XPS. The instrument used for determining the ratio and measuring conditions are as follows.

1. Instrument: AXIS-ULTRA from Kratos Analytical
2. Measuring conditions
   (1) Light source: Al (in combination with monochromator)
   (2) Measurement power: 90 W (15 kV and 6 mA)
   (3) Measurement region: 900×600 pmt
   (4) Pass energy: 160 eV (wide scan), 40 eV (narrow scan)
   (5) Energy step: 1.0 eV (wide scan), 0.2 eV (narrow scan)
   (6) Relative sensitivity coefficient: Relative sensitivity coefficients presented by Kratos Analytical are used.
   (7) Magnet controller: OFF (because carrier is a magnetic material)

When measurements are performed, a sample is contained in a cylindrical hole of a chip having a depth of 0.3 mm and a flat surface of the sample is subjected to XPS. The instrument outputs amounts of all the elements included in the cover layer in units of atomic percent. The atomic ratio Ba/Si is determined from the amounts of Ba and Si.

The cover layer preferably satisfies the following relation:

$$1.0<D/h<2.0,$$

wherein D represents the volume average particle diameter of barium sulfate in units of micrometer, and h represents the thickness of the cover layer in units of micrometer.

When the ratio D/h is less than 1.0, particles of barium sulfate tend to be buried in the cover layer, and the number of particles projecting from the surface of the cover layer decreases, resulting in deterioration of the spent toner problem preventing effect. In addition, since the cover layer is easily abraded due to decrease of the number of particles projecting from the surface of the cover layer, the resistance of the carrier largely decreases after long repeated agitation, resulting in occurrence of the carrier adhesion problem.

By contrast, when the ratio D/h is greater than 2.0, the area of the surfaces of barium sulfate particles contacted with the resin of the cover layer decreases, and thereby barium sulfate particles are easily released, resulting in decrease of the resistance of the carrier.

Figure 4:
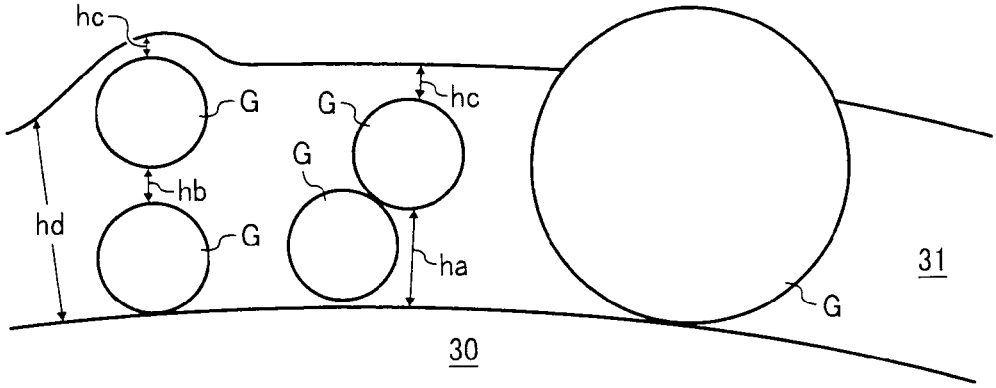
FIG. 4 is a schematic view illustrating an example of a cover layer of the carrier of the present invention.

The average thickness h (μm) of the resinous portion of the cover layer is determined as follows. Specifically, the cross sections of carrier particles are observed with a transmission electron microscope (TEM) to determine thicknesses of 50 points of the resinous portions. In this regard, the thicknesses of only resinous portions present between a barium sulfate particle and the surface of the core material and resinous portions constituting the cover layer by itself are measured. Namely, in FIG. 4 illustrating an example of the cover layer, among thicknesses ha, hb, hc and hd, only the thicknesses ha and hd of resinous portions of the cover layer are measured. The average thickness h (in units of micrometer) of the cover layer is determined by averaging the 50 thickness data thus-obtained. In FIG. 4, reference numerals 30 and 31 respectively denote a carrier particle and a cover layer, and reference character G denotes particles of a barium sulfate compound.

The volume average particle diameter (D) of barium sulfate is determined by the following method.

At first, 30 ml of an aminosilane coupling agent (SH6020 from Dow Corning Toray Silicone Co., Ltd., and 300 ml of toluene are fed into a juicing blender, and then 6.0 g of a sample is fed thereinto. The mixture is agitated by the juicing blender for 3 minutes while the rotation speed dial of the juicing blender is set to a "low" level to prepare a dispersion. Next, a proper amount of the thus prepared dispersion is mixed with 500 ml of toluene in a 1-liter beaker to be diluted. The diluted dispersion is always agitated with a homogenizer until the measurement operation is completed. Next, the volume average particle diameter of the sample in the diluted dispersion is measured with a super centrifugal automatic particle diameter distribution measuring instrument, CAPA-700 from Horiba Ltd. The measuring conditions are as follows.

Rotation speed: 2,000 rpm

Measurable maximum particle diameter: 2.0 μm

Measurable minimum particle diameter: 0.1 μm

Interval of particle diameter (i.e., width of one particle diameter range): 0.1 μm Viscosity of dispersing medium: 0.59 mPa·s Density of dispersing medium: 0.87 g/cm$^3$ Density of particle: Data of the true specific gravity of the sample, which is determined using a dry automatic bulk density measuring instrument MICROMERITICS GAS PYCNOMETER ACCUPYC 1330 from Shimadzu Corp., is input to the instrument CAPA-700.

The cover layer can optionally include a particulate electroconductive material to control the volume resistivity of the carrier. Specific examples of such a particulate electroconductive material include carbon blacks, indium tin oxide (ITO), tin oxide, and zinc oxide, but are not limited thereto. These electroconductive materials can be used alone or in combination.

The resistivity (R) of an electroconductive material included in the cover layer is preferably from 0.5 to 3 in a logarithmic scale, i.e., (log R(Ω·cm)). The logarithmic resistivity of an electroconductive material is measured by the following method.

At first, a sample is contained in a cylindrical polyvinyl chloride tube having a diameter of 1 inch (i.e., 2.54 cm) and equipped with an electrode at the bottom thereof, and an electrode having a diameter of 1 inch is inserted from the top of the tube to sandwich the sample with the two electrodes. While a pressure of 10 kg/cm$^2$ is applied to the electrodes, the resistance (r(Ω)) of the sample is measured by an LCR meter 4216A from Hewlett Packard Japan Ltd. The logarithmic resistivity (log R(Ω·cm)) of the sample is calculated from the following equation.

$$\log R(\Omega\cdot\text{cm})=\log\,[r\times\pi(2.54/2)^2/H],$$

wherein H represents the distance between the two electrodes (i.e., the thickness of the sample).

The amount of an electroconductive material included in the cover layer coating liquid is not particularly limited, but is preferably from 0.1 parts by weight to 1,000 parts by weight based on 100 parts by weight of a silicone resin included in the cover layer coating liquid. When the added amount is less than 0.1 parts by weight, the effect of controlling the volume resistivity of the carrier cannot be satisfactorily produced. By contrast, when the added amount is greater than 1,000 parts by weight, it becomes difficult for the cover layer to bear the electroconductive material, resulting in breaking down of the cover layer.

The cover layer coating medium can optionally include a silane coupling agent to stably disperse a particulate electroconductive material therein.

Specific examples of such a silane coupling agent, include, but are not limited thereto, γ-(2-aminoethyl)aminopropyltrimethoxysilane, γ-(2-aminoethyl)aminopropyldimethoxysilane, γ-methacryloxypropyltrimethoxysilane, N-β-(N-vinylbenzylaminoethyl)-γ-aminopropyltrimethoxysilane) hydrochloride, γ-glycidoxypropyltrimethoxysilane, γ-mercaptopropyltrimethoxysilane, methyltrimethoxysilane, methyltriethoxysilane, vinyltriacetoxylsilane, γ-chloropropyltrimethoxysilane, hexamethyldisilazane, γ-anilinopropyltrimethoxysilane, vinyltrimethoxylsilane, octadecyldimethyl [3-(trimethoxysilyl)propyl]ammonium chloride, γ-chloropropylmethyldimethoxysilane, methyltrichlorosilane, dimethyldichlorosilane, trimethylchlorosilane, allyltrimethoxysilane, 3-aminopropylmethyldiethoxysilane, 3-aminopropyltrimethoxysilane, dimethyldiethoxysilane, 1,3-divinyltetramethyldisilazane, and methacryloxyethyldimethyl(3-trimethoxysilylpropyl)ammonium chloride. These silane coupling agents can be used alone or in combination.

Specific examples of marketed silane coupling agents include AY43-059, SR6020, SZ6023, SH6026, SZ6032, SZ6050, AY43-310M, SZ6030, SH6040, AY43-026, AY43-031, SH6062, Z-6911, SZ6300, SZ6075, SZ6079, SZ6083, SZ6070, SZ6072, Z-6721, AY43-004, Z-6187, AY43-021, AY43-043, AY43-040, AY43-047, Z-6265, AY43-204M, AY43-048, Z-6403, AY43-206M, AY43-206E, Z-6341, AY43-210MC, AY43-083, AY43-101, AY43-013, AY43-158E, Z-6920, and Z-6940, which are from Toray Silicone Co., Ltd.

The amount of a silane coupling agent included in the cover layer coating medium is preferably from 0.1 parts by weight to 10 parts by weight based on 100 parts by weight of a silicone resin included in the cover layer coating liquid. When the added amount is less than 0.1 parts by weight, adhesion of a silicone resin to a core material and a particulate electroconductive material tends to deteriorate, resulting in peeling of the cover layer from the core material after long repeated use. By contrast, adding a silane coupling agent in an amount of greater than 10 parts by weight often causes the toner filming problem mentioned above after long repeated use.

The cover layer of the carrier of the present invention can be formed by using a cover layer composition including a silicone resin having at least one of a silanol group and a hydrolyzable group capable of forming a silanol group when being hydrolyzed, a catalyst, and optionally including a resin other than such a silicone resin as mentioned above, a particulate electroconductive material, a silane coupling agent, a solvent, etc.

Specific examples of the method for forming a cover layer on the surface of a core material include a method in which a core material is covered with such a cover layer composition as mentioned above while subjecting silanol groups of the silicone resin to a condensation reaction using heat or light; a method in which a core material is covered with such a cover layer composition as mentioned above, and then silanol groups of the silicone resin are subjected to a condensation reaction using heat; etc.

After covering a core material with such a cover layer composition, the composition is preferably subjected to a heat treatment so that the condensation reaction of the silicone resin proceeds, resulting in enhancement of the mechanical strength of the cover layer. Since the thus prepared cover layer has little abrasion loss even after long repeated use, occurrence of the carrier adhesion problem to be caused by decrease of the electric resistance of the carrier due to abrasion of the cover layer thereof can be prevented.

The temperature of such a heat treatment is generally from 100° C. to 230° C. When the temperature is lower than 100° C., the condensation reaction does not satisfactorily proceed, resulting in formation of a cover layer having an insufficient mechanical strength. By contrast, when the temperature is higher than 230° C., the resultant cover layer often changes in color. When such a colored cover layer is abraded and then mixed with a color toner, a color image having a color different from the desired color (i.e., mixture of the color of the color toner and the color of the abraded cover layer) is formed.

Specific examples of the resins for use in the cover layer other than silicone resins having at east one of a silanol group and a hydrolysable group include acrylic resins, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and vinyl fluoride, fluoroterpolymers such as termpolymers of tetrafluoroethylene, vinylidene fluoride and a non-fluorinated monomer, silicone resins which do not have both of a silanol group and a hydrolysable group, etc. These resins can be used alone or in combination. Among these resins, acrylic resins are preferable because of having good adhesion to core materials and electroconductive materials, and low brittleness.

Acrylic resins for use in the cover layer preferably have a glass transition temperature of from 20° C. to 100° C., and more preferably from 25° C. to 80° C. Since such acrylic resins have proper elasticity, the resultant cover layer formed on a carrier can absorb shock caused when the carrier particles are rubbed with each other and toner particles, thereby preventing the cover layer from damaging while imparting a proper charge to the developer.

A crosslinked material obtained by reacting an acrylic resin with an amino resin is preferably included in the cover layer to impart a proper elasticity to the cover layer and to prevent aggregation of the carrier particles due to adhesion of the cover layer to each other.

Among such amino resins, melamine resins and benzoguanamine resins are preferable because of having a good charge imparting ability, but the amino resin for use in the cover layer is not limited thereto. In a case in which the charge imparting ability of the carrier is controlled so as to be proper, it is preferable to use a combination of at least one of a melamine resin and a benzoguanamine resin, and another amino resin.

Acrylic resins capable of reacting with such amino resins as mentioned above are not particularly limited, but it is preferable to use acrylic resins having at least one of a hydroxyl group and a carboxyl group (more preferably a hydroxyl group) to further improve adhesion of the cover layer with the core material and to satisfactorily disperse a particulate electroconductive material in the cover layer due to improvement of adhesion of the resin with the particulate electroconductive material. Such acrylic resins preferably have a hydroxyl value of not lower than 10 mgKOH, and more preferably not lower than 20 mgKOH.

The average thickness of the cover layer is preferably from 0.05 μm to 4 μm. When the thickness is less than 0.05 μm, the cover layer is easily damaged or worn out. By contrast, when the thickness is greater than 4 μm, the carrier adhesion problem is often caused because the cover layer is not a magnetic material and thereby magnetic attraction between the carrier particles and a developer bearing member having a magnet therein decreases.

The core material is not particularly limited as long as the core material is a magnetic material. Specific examples of the core material include ferromagnetic metals such as iron and cobalt, iron oxides such as magnetite, hematite and ferrite, ferromagnetic alloys and compounds, particulate resins in which one or more of these magnetic materials are dispersed, etc. Among these materials, manganese ferrite, manganese-magnesium ferrite and manganese-magnesium-strontium ferrite are preferable in view of environmental protection.

The core material preferably has a weight average particle diameter of from 20 μm to 65 μm. When the weight average particle diameter of the core material is less than 20 μm, the carrier adhesion problem is often caused. By contrast, when the weight average particle diameter is greater than 65 μm, reproducibility of fine line images tends to deteriorate, i.e., high definition images cannot be produced.

The weight average particle diameter of a core material is measured by a particle size analyzer, MICROTRACK HRA9320-X-100 from Nikkiso Co., Ltd.

The carrier of the present invention preferably has a magnetization of from 40 $Am^2/kg$ to 90 $Am^2/kg$ at a magnetic field of 1 kOe ($10^6/4\pi$[A/m]). When the magnetization is lower than 40 $Am^2/kg$, the carrier adhesion problem is often caused. By contrast, when the magnetization is greater than 90 $Am^2/kg$, the magnetic brush formed on a developer bearing member becomes too hard, thereby forming low density images. The magnetization of a carrier is measured by an instrument VSM-P7-15 from Toei Industry Co., Ltd.

The carrier of the present invention preferably has a logarithmic volume resistivity of from 9.0 (log(Ω·cm)) to 17.0 (log(Ω·cm)). When the logarithmic volume resistivity is lower than 9.0 (log(Ω·cm)), carrier particles often adhere to background portions of images. By contrast, when the logarithmic volume resistivity is higher than 17.0 (log(Ω·cm)), images with strong edge effect are often produced.

The volume resistivity of a carrier is measured using a cell illustrated in FIG. 1. Specifically, a carrier 3 is contained in a cell 1, which is made of a fluorine-containing resin and which has electrodes 1*a* and 1*b*, wherein each of the electrodes 1*a* and 1*b* has a dimension of 2.5 cm×4 cm and the distance between the electrodes 1*a* and 1*b* is 0.2 cm. After the carrier is fed into the cell so as to overflow from the cell without applying a pressure to the carrier, the cell is tapped 10 times at a tapping speed of 30 times per minute, and a nonmagnetic flat blade is slid once along the upper surface of the cell to remove the projected portion of the carrier projected from the upper surface of the cell. Next, a DC voltage of 1,000V is applied between the electrodes 1*a* and 1*b*, and the resistance r (Ω) of the carrier is measured with an instrument, HIGH RESISTANCE METER 4329A from Hewlett-Packard Japan, Ltd. The volume resistivity R (Ω·cm) of the carrier is determined from the following equation (1):

$$R=r(2.5\times4)/0.2 \quad (1).$$

The developer of the present invention includes the carrier mentioned above and a toner.

The toner is a monochrome toner (such as black toner) or a color toner (such as yellow, magenta and cyan toners), which includes at least a binder resin and a colorant. In order that a developer can be used for an oil-less fixing device, in which an oil preventing adhesion of toner to the fixing roller thereof is not applied, toner included in the developer may include a release agent. Such toner tends to cause the toner filming problem in that a toner film is formed on the surface of the carrier used in combination with the toner, thereby degrading the charging ability of the carrier. However, since the carrier of the present invention can prevent occurrence of the toner filming problem, the developer of the present invention can maintain good developing property over a long period of time. In addition, when the cover layer of a carrier is abraded and the abraded cover layer is mixed with a color toner (particularly a yellow toner), the color of the color toner changes, resulting in deterioration of the color reproducibility of the developer. However, since the carrier of the present invention has good abrasion resistance, the developer of the present invention can prevent occurrence of the color changing problem.

The method for preparing the toner for use in the developer of the present invention is not particularly limited. Specific examples of the method include pulverization methods, polymerization methods, etc.

Pulverization methods typically include the following processes:

(1) kneading toner components such as a binder resin and a colorant upon application heat and shearing force thereto;

(2) cooling the kneaded toner component mixture to solidify the mixture;

(3) pulverizing the solidified mixture;

(4) classifying the pulverized toner component mixture, thereby preparing toner particles (i.e., a mother toner); and (5) mixing an external additive with the toner particles to improve the durability thereof, resulting in preparation of a toner.

Specific examples of the kneading machines include batch kneading machines such as two-roll mills, and BANBURY MIXER, and continuous kneaders such as twin screw extruders and single screw extruders. Specific examples of the twin screw extruders include KTK twin screw extruders from Kobe Steel, Ltd., TEM twin screw extruders from Toshiba Machine Co., Ltd., twin screw extruders from KCK Co., Ltd., PCM twin screw extruders from Ikegai Corp., KEX twin screw extruders from Kurimoto Ltd., etc. Specific examples of the single screw extruders include KO-KNEADER from Buss AG.

In the pulverization process, it is preferable to crush the solidified mixture using a crusher such as hammer mills, and cutter mills (e.g., ROATPLEX from Hosokawa Micron Corp.), and then pulverizing the crushed toner component mixture using a pulverizer such as jet air pulverizers and mechanical pulverizers. In this regard, it is preferable to perform pulverization so that the resultant toner particles have an average particle diameter of from 3 μm to 15 μm.

It is preferable to use an air classifier for the classification process. In the classification process, the toner particles are classified so as to have an average particle diameter of from 5 μm to 20 μm.

The external additive adding process is performed using a mixer so that the external additive is adhered to the surface of the toner particles while dissociated.

Specific examples of the resins for use as the binder resin of the toner include homopolymers of styrene and substituted styrene such as polystyrene and polyvinyl toluene; styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic acid copolymers and styrene-maleic acid ester copolymers; acrylic resins such as polymethyl methacrylate, and polybutyl methacrylate; and other resins such as polyvinyl chloride, polyvinyl acetate, polyethylene, polypropylene, polyesters, polyurethane resins, epoxy resins, polyvinyl butyral resins, polyacrylic acid resins, rosin, modified rosins, terpene resins, phenolic resins, aliphatic or alicyclic hydrocarbon resins, aromatic petroleum resins, etc. These resins are used alone or in combination.

Not only heat-fixable toner but also pressure-fixable toner can be used as the toner. Specific examples of the resins for use as the binder resin of such pressure-fixable toner include polyolefin (e.g., low molecular weight polyethylene and low molecular weight polypropylene), ethylene-acrylic copolymers, ethylene-acrylate copolymers, ethylene-methacrylate copolymers, ethylene-vinyl chloride copolymers, ethylene-vinyl acetate copolymers, olefin copolymers (e.g., ionomer resins), epoxy resins, polyester resins, styrene-methacrylic acid copolymers, styrene-butadiene copolymers, polyvinyl pyrrolidone, methyl vinyl ether-maleic anhydride copolymers, maleic acid modified phenolic resins, phenol modified terpene resins, etc. These resins are used alone or in combination.

Various colorants such as yellow pigments, orange pigments, red pigments, violet pigments, blue pigments, green pigments, black pigments, etc. can be used for the toner used in combination with the carrier of the present invention. These colorants are used alone or in combination.

Specific examples of the yellow pigments include Cadmium Yellow, Pigment Yellow 155, benzimidazolone, Mineral Fast Yellow, Nickel Titan Yellow, Naples Yellow, NEPHTHOL YELLOW S, HANZA YELLOW G, HANZA YELLOW 10G, BENZIDINE YELLOW GR, Quinoline Yellow Lake, PERMANENT YELLOW NCG, Tartrazine Lake, etc.

Specific examples of the orange pigments include Molybdenum Orange, PERMANENT ORANGE GTR, Pyrazolone Orange, VULVAN ORANGE, INDANTHRENE BRILLIANT ORANGE RK, BENZIDINE ORANGE G, INDANTHRENE BRILLIANT ORANGE GK, etc.

Specific examples of the red pigments include red iron oxide, Quinacridone Red, cadmium red, PERMANENT RED 4R, Lithol Red, Pyrazolone Red, Watchung Red calcium salt, Lake Red D, Brilliant Carmine 6B, Eosin Lake, Rhodamine Lake B, Alizarine Lake, Brilliant Carmine 3B, etc.

Specific examples of the violet pigments include Fast Violet B, and Methyl Violet Lake, etc.

Specific examples of the blue pigments include cobalt blue, Alkali Blue, Victoria Blue Lake, Phthalocyanine Blue, metal-free Phthalocyanine Blue, partially-chlorinated Phthalocyanine Blue, Fast Sky Blue, INDANTHRENE BLUE BC, etc.

Specific examples of the green pigment include Chrome Green, chromium oxide, Pigment Green B, Malachite Green Lake, etc.

Specific examples of the black pigments include carbon black, oil furnace black, channel black, lamp black, acetylene black, azine dyes such as aniline black, metal salts of azo dyes, metal oxides, complex metal oxides, etc.

These pigments can be used alone or in combination.

Specific examples of the release agent for use in the toner used in combination with the carrier of the present invention include polyolefin (e.g., polyethylene and polypropylene), fatty acid metal salts, fatty acid esters, paraffin waxes, amide waxes, polyalcohol waxes, silicone varnishes, carnauba waxes, ester waxes, etc.

The toner can optionally include a charge controlling agent. Specific examples of such a charge controlling agent include Nigrosine, azine dyes having 2 to 16 carbon atoms (disclosed in published examined Japanese patent application No. 42-1627), basic dyes, lake pigments of basic dyes, quaternary ammonium salts, dialkyltin compounds, dialkyltin borate compounds, guanidine derivatives, polyamine resins, metal complexes of monoazo dyes, salicylic acid derivatives, metal complexes of acids, sulfonated copper phthalocyanine pigments, organic boron salts, fluorine-containing quaternary ammonium salts, calixarene compounds, etc. These compounds can be used alone or in combination.

Specific examples of the basic dyes include C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000).

Specific examples of the quaternary ammonium salts include C.I. Solvent Black 8 (C.I. 26150), benzoylmethylhexadecylammonium chloride, and decyltrimethylammonium chloride.

Specific examples of the dialkyltin compounds include dibutyltin compounds, and dioctyltin compounds.

Specific examples of the polyamine resins include vinyl polymers having an amino group, and condensation polymers having amino group.

Specific examples of the metal complexes of monoazo dyes include metal complexes of monoazo dyes disclosed in published examined Japanese patent applications Nos. (hereinafter JP-B) 41-20153, 43-27596, 44-6397, and 45-26478.

Specific examples of the salicylic acid derivatives include compounds disclosed in JP-Bs 55-42752 and 59-7385.

Specific examples of the metal complexes of acids include metal (e.g., Zn, Al, Co, Cr and Fe) complexes of dialkylsalicylic acids, naphthoic acid, and dicarboxylic acids.

Among these charge controlling agents, salicylic acid derivatives (such as metal complexes) having white color are preferably used for color toners.

Materials for use as the external additive are not particularly limited, and specific examples thereof include particulate inorganic materials (such as silica, titanium oxide, alumina, silicon carbide, silicon nitride and boron nitride), particulate resins (such as polymethyl methacrylate and polystyrene) having an average particle diameter of from 0.05 μm to 1 μm, etc. These materials are used alone or in combination.

Among these materials, metal oxides such as silica and titanium oxide, whose surface is hydrophobized, are preferable. It is more preferable to use a combination of a hydrophobized silica and a hydrophobized titanium oxide, wherein the added amount of hydrophobized silica is greater than that of the hydrophobized titanium oxide, so that the resultant toner can maintain good charge stability even when environmental humidity changes.

Next, the method for preparing the carrier of the present invention will be described.

The carrier preparation method includes applying a coating medium including barium sulfate, a copolymer having at least a unit A having the above-mentioned formula (1) and a unit (B) having the above-mentioned formula (2), and a condensation catalyst to a surface of a particulate core material, and heating the applied medium so that the copolymer is hydrolyzed to form a material having a silanol group, and the material and the catalyst are subjected to a condensation reaction to form a cover layer including a crosslinked material and barium sulfate on the surface of the particulate core material. The detailed method will be described later by reference to examples. In addition, all the matters pertaining to the carrier of the present invention and described above are also applied to the carrier preparation method.

Next, the developer container containing the developer of the present invention will be described.

Figure 3:
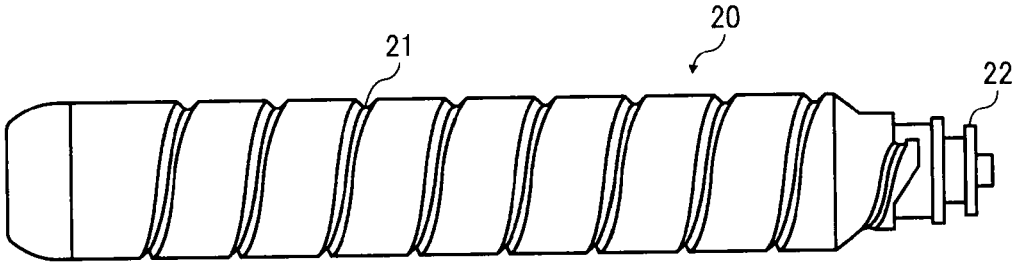
FIG. 3 is a schematic view illustrating an example of the developer container of the present invention.

The developer container contains the developer of the present invention. The shape, size and constitutional material of the developer container are not particularly limited. FIG. 9 illustrates an example of the developer container. Referring to FIG. 3, a developer container 20 containing the developer of the present invention has a spiral groove 21 (i.e., a spiral projection on the inner surface of the container), and a cap 22. After removing the cap 22 and the container is set to an image forming apparatus or a process cartridge, the developer 20 in the container is fed along the spiral projection to the entrance of the container when the container is rotated, resulting in supply of the developer to a developing device of the image forming apparatus or the process cartridge. A portion or entire of the spiral portion may have an accordion like configuration so as to shrink as the amount of the developer therein decreases.

The constitutional material of the container is not particularly limited, but materials having good dimensional precision such as resins are preferably used. Among various resins, polyester resins, polyethylene resins, polypropylene resins, polystyrene resins, polyvinyl chloride resins, acrylic resins, polycarbonate resins, ABS resins, polyacetal resins, etc. are preferably used.

The developer container of the present invention has a good combination of preservability, transportability and handling property. The developer container can be detachably attachable to the process cartridge described later.

Next, the image forming method and the process cartridge of the present invention will be described.

The image forming method of the present invention includes:

(1) an electrostatic latent image forming process in which an electrostatic latent image is formed on an image bearing member (such as a photoreceptor);

(2) a developing process in which the electrostatic latent image is developed with the developer of the present invention to form a toner image on the image bearing member;

(3) a transfer process in which the toner image on the image bearing member is transferred onto a recording material; and (4) a fixing process in which the toner image is fixed to the recording material, resulting in formation of a copy.

The process cartridge of the present invention includes at least an image bearing member configured to bear an electrostatic latent image, and a developing device configured to develop the electrostatic latent image on the image bearing member with the developer of the present invention to form a toner image on the image bearing member, wherein the image bearing member and the developing device are integrated.

Figure 2:
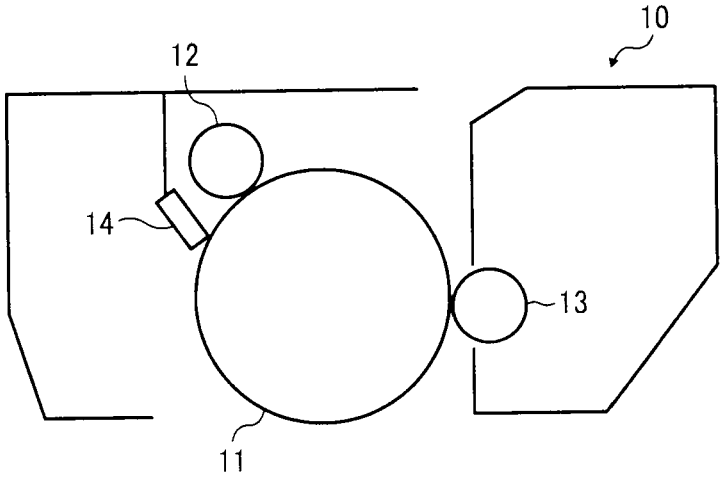
FIG. 2 is a schematic view illustrating an example of the process cartridge of the present invention.

FIG. 2 illustrates an example of the process cartridge of the present invention. Referring to FIG. 2, a process cartridge 10 includes a photoreceptor 11 serving as an image bearing member, a charger 12 configured to charge the photoreceptor, a developing device 13 configured to develop an electrostatic latent image, which is formed on the photoreceptor by irradiating the charged photoreceptor with light emitted from a light irradiating device, with the developer of the present invention to form a toner image on the photoreceptor, and a cleaner 14 configured to clean the surface of the photoreceptor after the toner image is transferred onto a recording material. These devices are integrated, and the process cartridge can be detachably attachable to an image forming apparatus such as copiers, printers and facsimile machines.

Next, the image forming method using an image forming apparatus to which the process cartridge is attached will be described.

At first, the photoreceptor 11 is rotated at a predetermined peripheral velocity, and the charger 12 charges the circumferential surface of the photoreceptor so that the surface of the photoreceptor has a predetermined positive or negative potential. Next, a light irradiating device (such as slit type light irradiating devices and laser beam scanning type light irradiating devices, not shown) of the image forming apparatus irradiates the charged surface of the photoreceptor 11, resulting in formation of an electrostatic latent image on the surface of the photoreceptor. The developing device develops the electrostatic latent image on the surface of the photoreceptor with the developer of the present invention, resulting in formation of a toner image on the surface of the photoreceptor. The toner image formed on the photoreceptor is then transferred onto a sheet of a recording material, which is timely fed from a recording material feeding device (not shown) of the image forming apparatus. The recording material sheet bearing the toner image thereon is fed to a fixing device (not shown) of the image forming apparatus so that the toner image is fixed to the recording material sheet, resulting in formation of a copy. The copy is discharged from the image forming apparatus. Meanwhile, the circumferential surface of the photoreceptor 11 is cleaned by the cleaner to remove residual toner particles from the surface of the photoreceptor, followed by a discharging treatment using a discharging device (not shown) of the image forming apparatus to reduce the potential remaining on the surface of the photoreceptor, so that the photoreceptor is ready for the next image forming operation.

When the developer is used as a supplementary developer to be supplementarily supplied to a developing device, the weight ratio (C/T) of the carrier (C) of the present invention to a toner (T) in the developer is preferably from 1/2 to 1/50. By supplying the developer of the present invention as a supplementary developer while discharging excess of the developer in a developing device to gradually replace the developer in the developing device with the supplementary developer (i.e., fresh developer), images having good image qualities can be produced over a long period of time. Namely, since the lightly deteriorated developer in the developing device is replaced with a fresh developer, the developer in the developing device can maintain the desired amount of charge over a long period of time, thereby forming toner images having good image qualities. This technique is particularly effective for a case in which images with high image area ratios are continuously produced. When images with high image area ratios are continuously produced, toner tends to be adhered to the surface of a carrier, resulting in occurrence of the above-mentioned spent toner problem, resulting in deterioration of the charging ability of the carrier. However, by using the carrier of the present invention and this technique, high quality images can be produced over a long period of time even when the images have high image area ratios. This is because the carrier of the present invention has good resistance to the spent toner problem, and part of the developer in the developing device is replaced with a fresh developer.

In this regard, all the matters pertaining to the toner for use in the developer of the present invention and described above are also applied to this toner.

The weight ratio (C/T) of the carrier (C) of the present invention to a toner (T) in the supplementary developer is not particularly limited as long as the ratio falls in a range of from 1/2 to 1/50. When the ratio (C/T) is greater than 1/2, the content of the carrier in the supplementary developer becomes too high, resulting in excessive increase of the carrier concentration in the developer in a developing device, thereby excessively increasing the charge of the developer (toner). When the charge of the developer in the developing device excessively increases, the developing ability of the developer deteriorates, thereby forming images with a low image density. By contrast, when the ratio (C/T) is less than 1/50, the content of the carrier in the supplementary developer becomes too low, thereby hardly replacing the carrier in the developer in a developing device with a fresh carrier, and therefore the carrier deterioration preventing effect is hardly produced.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Copolymer Synthesis Example 1

At first, 500 g of toluene was fed into a flask equipped with an agitator, and heated to 90° C. under a nitrogen gas flow. Next, a mixture of the following components was dropped into the flask over 1 hour.

| | |
|---|---|
| 3-Methacryloxypropyltris(trimethylsiloxy)silane (i.e., component A1) ($CH_2$=CMe—COO—$C_3H_6$—Si(OSi$Me_3$)$_3$, SILAPLANE TM-0701T from Chisso Corp.) | 211 g (500 mmole) |
| 3-Methacryloxypropyltrimethoxysilane (i.e., component B1) | 124.0 g (500 mmole) |
| 2,2'-Azobis-2-methylbutylonitrile (catalyst) | 0.58 g (3 mmole) |

Next, a solution of the catalyst which had been prepared by dissolving 0.06 g (0.3 mmole) of 2,2'-azobis-2-methylbutylonitrile in 15 g of toluene was fed into the flask (i.e., the total added amount of 2,2'-azobis-2-methylbutylonitrile is 0.64 g (3.3 mmole)). The mixture was heated for 3 hours in a temperature range of from 90 to 100° C. to perform a radical polymerization reaction. Thus, a solution of a methacrylic copolymer (hereinafter referred to as methacrylic copolymer 1) in which the molar ratio (A1/B1) of the component A1 to the component B1 is 5/5 was prepared.

The weight average molecular weight of the methacrylic copolymer 1 was 35,000.

The solution was diluted with toluene so that the content of non-volatile components in the solution is 25% by weight. The viscosity of the diluted solution of the methacrylic copolymer 1 was 8.5 $mm^2/s$, and the specific gravity thereof was 0.91.

Copolymer Synthesis Example 2

The procedure for preparation of the methacrylic copolymer 1 in Copolymer Synthesis Example 1 was repeated except that the component B1 3-methacryloxypropyltrimethoxysilane was replaced with 145 g (500 mmole) of 3-methacryloxypropyltriethoxysilane (hereinafter referred to as component B2). Thus, a solution of a methacrylic copolymer 2 in which the molar ratio (A1/B2) of the component A1 to the component B2 is 5/5 was prepared.

The weight average molecular weight of the methacrylic copolymer 2 was 33,000.

The solution was diluted with toluene so that the content of non-volatile components in the solution is 25% by weight. The viscosity of the diluted solution of the methacrylic copolymer 2 was 8.6 $mm^2/s$, and the specific gravity thereof was 0.92.

Copolymer Synthesis Example 3

The procedure for preparation of the methacrylic copolymer 1 in Copolymer Synthesis Example 1 was repeated except that the added amount of the component A1 (3-methacryloxypropyltris(trimethylsiloxy)silane) was changed from 211 g (500 mmole) to 379.8 g (900 mmole), and added amount of the component B1 (3-methacryloxypropyltrimethoxysilane) was changed from 124.0 (500 mmole) to 24.8 g (100 mmole). Thus, a solution of a methacrylic copolymer 3 in which the molar ratio (A1/B1) of the component A1 to the component B1 is 9/1 was prepared.

The weight average molecular weight of the methacrylic copolymer 3 was 37,000.

The solution was diluted with toluene so that the content of non-volatile components in the solution is 25% by weight. The viscosity of the diluted solution of the methacrylic copolymer 3 was 8.4 $mm^2/s$, and the specific gravity thereof was 0.92.

Copolymer Synthesis Example 4

The procedure for preparation of the methacrylic copolymer 1 in Copolymer Synthesis Example 1 was repeated except that the added amount of the component A1 (3-methacryloxypropyltris(trimethylsiloxy)silane) was changed from 211 g (500 mmole) to 42.2 g (100 mmole), and added amount of the component B1 (3-methacryloxypropyltrimethoxysilane) was changed from 124.0 (500 mmole) to 223.2 g (900 mmole). Thus, a solution of a methacrylic copolymer 4 in which the molar ratio (A1/B1) of the component A1 to the component B1 is 1/9 was prepared.

The weight average molecular weight of the methacrylic copolymer 4 was 34,000.

The solution was diluted with toluene so that the content of non-volatile components in the solution is 25% by weight. The viscosity of the diluted solution of the methacrylic copolymer 4 was 8.7 $mm^2/s$, and the specific gravity thereof was 0.90.

Copolymer Synthesis Example 5

The procedure for preparation of the methacrylic copolymer 1 in Copolymer Synthesis Example 1 was repeated except that the added amount of the component A1 (3-methacryloxypropyltris(trimethylsiloxy)silane) was changed from 211 g (500 mmole) to 422 g (1000 mmole), and the component B1 (3-methacryloxypropyltrimethoxysilane) was not added. Thus, a solution of a methacrylic copolymer 5 in which the molar ratio (A1/B1) of the component A1 to the component B1 is 10/0 was prepared.

The weight average molecular weight of the methacrylic copolymer 5 was 37,000.

The solution was diluted with toluene so that the content of non-volatile components in the solution is 25% by weight. The viscosity of the diluted solution of the methacrylic copolymer 5 was 8.4 $mm^2/s$, and the specific gravity thereof was 0.91.

Copolymer Synthesis Example 6

The procedure for preparation of the methacrylic copolymer 1 in Copolymer Synthesis Example 1 was repeated except that the component A1 (3-methacryloxypropyltris(trimethylsiloxy)silane) was not added, and the added amount of the component B1 (3-methacryloxypropyltrimethoxysilane) was changed from 124.0 g (500 mmole) to 248.0 g (1000 mmole). Thus, a solution of a methacrylic copolymer 6 in which the molar ratio (A1/B1) of the component A1 to the component B1 is 0/10 was prepared.

The weight average molecular weight of the methacrylic copolymer 6 was 33,000.

The solution was diluted with toluene so that the content of non-volatile components in the solution is 25% by weight. The viscosity of the diluted solution of the methacrylic copolymer 6 was 8.7 $mm^2/s$, and the specific gravity thereof was 0.90.

Copolymer Synthesis Example 7

The procedure for preparation of the methacrylic copolymer 1 in Copolymer Synthesis Example 1 was repeated except that the component A1 (3-methacryloxypropyltris(trimethylsiloxy)silane) was replaced with 168.5 g (250 mmole) of a component A2 4-acryloxybutyltris(triisoprpylsiloxy)silane having formula $CH_2{=}CH{-}COO{-}C_4H_8{-}Si(OSiPr_3)_3$, wherein Pr represents a propyl group, and the component B1 (3-methacryloxypropyltrimethoxysilane) was replaced with 83 g (250 mmole) of a compound B3 3-methacryloxypropyltris(isopropoxy)silane. Thus, a solution of a methacrylic copolymer 7 in which the molar ratio (A3/B2) of the component A2 to the component B3 is 5/5 was prepared.

The weight average molecular weight of the methacrylic copolymer 7 was 39,000.

The solution was diluted with toluene so that the content of non-volatile components in the solution is 25% by weight. The viscosity of the diluted solution of the methacrylic copolymer 7 was 8.9 $mm^2/s$, and the specific gravity thereof was 0.94.

Copolymer Synthesis Example 8

The procedure for preparation of the methacrylic copolymer 1 in Copolymer Synthesis Example 1 was repeated except that the added amount of toluene was changed from 500 g to 300 g, the added amount of the component A1 (3-methacryloxypropyltris(trimethylsiloxy)silane) was changed from 211 g (500 mmole) to 84.4 g (200 mmole), the added amount of the component B1 (3-methacryloxypropyltrimethoxysilane) was changed from 124.0 g (500 mmole) to 37.2 g (150 mmole), and 65.0 g (650 mmole) of a component C1, methyl methacrylate ($CH_2{=}CMe{-}COOMe$) was added. Thus, a solution of a methacrylic copolymer 8 in which the molar ratio (A1/B1/C1) of the component A1 and the component B1 to the component C1 is 2/1.5/6.5 was prepared.

The weight average molecular weight of the methacrylic copolymer 8 was 34,000.

The solution was diluted with toluene so that the content of non-volatile components in the solution is 25% by weight. The viscosity of the diluted solution of the methacrylic copolymer 8 was 8.7 $mm^2/s$, and the specific gravity thereof was 0.91.

Copolymer Synthesis Example 9

The procedure for preparation of the methacrylic copolymer 8 in Copolymer Synthesis Example 8 was repeated except that the added amount of the component A1 (3-methacryloxypropyltris(trimethylsiloxy)silane) was changed from 84.4 g (200 mmole) to 211 g (500 mmole), the component B1 (3-methacryloxypropyltrimethoxysilane) was not added, and the added amount of the component C1 (methyl methacrylate) was changed from 65.0 g (650 mmole) to 50.0 g (500 mmole). Thus, a solution of a methacrylic copolymer 9 in which the molar ratio (A1/C1) of the component A1 to the component C1 is 5/5 was prepared.

The weight average molecular weight of the methacrylic copolymer 9 was 34,000.

The solution was diluted with toluene so that the content of non-volatile components in the solution is 25% by weight. The viscosity of the diluted solution of the methacrylic copolymer 9 was 8.7 $mm^2/s$, and the specific gravity thereof was 0.91.

Copolymer Synthesis Example 10

The procedure for preparation of the methacrylic copolymer 8 in Copolymer Synthesis Example 8 was repeated except that the component A1 (3-methacryloxypropyltris(trimethylsiloxy)silane) was not added, the added amount of the component B1 (3-methacryloxypropyltrimethoxysilane) was changed from 37.2 g (150 mmole) to 124.0 g (500 mmole), and the added amount of the component C1 (methyl methacrylate) was changed from 65.0 g (650 mmole) to 50.0 g (500 mmole). Thus, a solution of a methacrylic copolymer 10 in which the molar ratio (B1/C1) of the component B1 to the component C1 is 5/5 was prepared.

The weight average molecular weight of the methacrylic copolymer 10 was 32,000.

The solution was diluted with toluene so that the content of non-volatile components in the solution is 25% by weight. The viscosity of the diluted solution of the methacrylic copolymer 10 was 8.5 $mm^2/s$, and the specific gravity thereof was 0.89.

Copolymer Synthesis Example 11

At first, 300 g of toluene was fed into a flask equipped with an agitator, and heated to 90° C. under a nitrogen gas flow. Next, a mixture of the following components was dropped into the flask over 1 hour.

| | |
|---|---|
| 3-Methacryloxypropyltris(trimethylsiloxy)silane (i.e., component A1) ($CH_2$=CMe—COO—$C_3H_6$—Si($OSiMe_3$)$_3$, SILAPLANE TM-0701T from Chisso Corp.) | 84.4 g (200 mmole) |
| 3-Methacryloxypropylmethyldiethoxysilane (i.e., component B4) | 39.0 g (150 mmole) |
| Methyl methacrylate (i.e., component C1) | 65.0 g (650 mmole) |
| 2,2'-Azobis-2-methylbutylonitrile (catalyst) | 0.58 g (3 mmole) |

Next, a solution of the catalyst which had been prepared by dissolving 0.06 g (0.3 mmole) of 2,2'-azobis-2-methylbutylonitrile in 15 g of toluene was fed into the flask (i.e., the total added amount of 2,2'-azobis-2-methylbutylonitrile is 0.64 g (3.3 mmole)). The mixture was heated for 3 hours in a temperature range of from 90 to 100° C. to perform a radical polymerization reaction. Thus, a solution of a methacrylic copolymer 11 in which the molar ratio (A1/B4/C1) of the component A1 and component B4 to the component C1 is 20/15/65 was prepared.

The weight average molecular weight of the methacrylic copolymer 11 was 33,000.

The solution was diluted with toluene so that the content of non-volatile components in the solution is 25% by weight. The viscosity of the diluted solution of the methacrylic copolymer 1 was 8.8 $mm^2/s$, and the specific gravity thereof was 0.91.

Copolymer Synthesis Example 12

The procedure for preparation of the methacrylic copolymer 11 in Copolymer Synthesis Example 11 was repeated except that 3-methacryloxypropylmethyldiethoxysilane was replaced with 37.2 g (150 mmole) of 3-methacryloxypropyltrimethoxysilane. Thus, a solution of a methacrylic copolymer 12 in which the molar ratio (A1/B1/C1) of the component A1 and component B1 to the component C1 is 20/15/65 was prepared.

The weight average molecular weight of the methacrylic copolymer 12 was 34,000.

The solution was diluted with toluene so that the content of non-volatile components in the solution is 25% by weight. The viscosity of the diluted solution of the methacrylic copolymer 10 was 8.7 $mm^2/s$, and the specific gravity thereof was 0.91.

Carrier Preparation Example 1

The following components were mixed to prepare a cover layer coating liquid having a solid content of 10% by weight.

| | |
|---|---|
| Solution of methacrylic copolymer 1 prepared above | 100 parts |
| Titanium diisopropoxybis(ethylacetoacetate) (catalyst, TC-750 from Matsumoto Fine Chemical Co., Ltd.) | 4 parts |
| Barium sulfate powder covered with oxygen-deficient tin oxide (PASTRAN 4310 from Mitsui Mining & Smelting Co., Ltd.) | 80 parts |
| Toluene | balance |

The above-prepared cover layer coating liquid was applied to a particulate manganese ferrite serving as a core material and having a weight average particle diameter Dw of 35 μm, followed by drying at 70° C., using a fluidized bed coating device so that the dried cover layer formed on the manganese ferrite has an average thickness of 0.20 μm.

The coated carrier was then heated for 2 hours at 180° C. using an electric furnace.

Specifically, the methacrylic copolymer 1 included in the coating liquid was hydrolyzed to prepare a material having a silanol group, and the material was condensed using the catalyst, titanium diisopropoxybis(ethylacetoacetate), thereby forming a crosslinked cover layer including barium sulfate on the core material.

Thus, a carrier 1 was prepared.

Carrier Preparation Example 2

The procedure for preparation of the carrier 1 in Carrier Preparation Example 1 was repeated except that the methacrylic copolymer 1 was replaced with the methacrylic copolymer 2 prepared above.

Thus, a carrier 2 was prepared.

Carrier Preparation Example 3

The procedure for preparation of the carrier 1 in Carrier Preparation Example 1 was repeated except that the methacrylic copolymer 1 was replaced with the methacrylic copolymer 3 prepared above.

Thus, a carrier 3 was prepared.

Carrier Preparation Example 4

The procedure for preparation of the carrier 1 in Carrier Preparation Example 1 was repeated except that the methacrylic copolymer 1 was replaced with the methacrylic copolymer 4 prepared above.

Thus, a carrier 4 was prepared.

Carrier Preparation Example 5

The procedure for preparation of the carrier 1 in Carrier Preparation Example 1 was repeated except that the added amount of the barium sulfate powder covered with oxygen-deficient tin oxide was changed from 80 parts to 40 parts.

Thus, a carrier 5 was prepared.

Carrier Preparation Example 6

The procedure for preparation of the carrier 1 in Carrier Preparation Example 1 was repeated except that the added amount of the barium sulfate powder covered with oxygen-deficient tin oxide was changed from 80 parts to 110 parts.

Thus, a carrier 6 was prepared.

Carrier Preparation Example 7

The procedure for preparation of the carrier 1 in Carrier Preparation Example 1 was repeated except that the barium sulfate powder covered with oxygen-deficient tin oxide was replaced with a barium sulfate powder (BF-10 from Sakai Chemical Industry Co., Ltd.).

Thus, a carrier 7 was prepared.

Carrier Preparation Example 8

The procedure for preparation of the carrier 1 in Carrier Preparation Example 1 was repeated except that the temperature of the heating treatment was changed from 180° C. to 100° C. Thus, a carrier 8 was prepared.

Carrier Preparation Example 9

The procedure for preparation of the carrier 1 in Carrier Preparation Example 1 was repeated except that the temperature of the heat treatment was changed from 180° C. to 230° C.

Thus, a carrier 9 was prepared.

Carrier Preparation Example 10

The procedure for preparation of the carrier 1 in Carrier Preparation Example 1 was repeated except that the average thickness of the cover layer was changed from 0.20 μm to 0.30 μm.

Thus, a carrier 10 was prepared.

Carrier Preparation Example 11

The procedure for preparation of the carrier 1 in Carrier Preparation Example 1 was repeated except that the methacrylic copolymer 1 was replaced with the methacrylic copolymer 7.

Thus, a carrier 11 was prepared.

Carrier Preparation Example 12

The procedure for preparation of the carrier 1 in Carrier Preparation Example 1 was repeated except that the methacrylic copolymer 1 was replaced with the methacrylic copolymer 8 prepared above.

Thus, a carrier 12 was prepared.

Carrier Preparation Example 13

The procedure for preparation of the carrier 1 in Carrier Preparation Example 1 was repeated except that the catalyst was replaced with 6 parts of titanium tetraacetylacetonate (TC-401 from Matsumoto Fine Chemical Co., Ltd.).

Thus, a carrier 13 was prepared.

Carrier Preparation Example 14

The procedure for preparation of the carrier 1 in Carrier Preparation Example 1 was repeated except that the catalyst was replaced with 4 parts of zirconium tetraacetylacetonate (ZC-150 from Matsumoto Fine Chemical Co., Ltd.).

Thus, a carrier 14 was prepared.

Carrier Preparation Comparative Example 1

The procedure for preparation of the carrier 1 in Carrier Preparation Example 1 was repeated except that the methacrylic copolymer 1 was replaced with the methacrylic copolymer 5 prepared above.

Thus, a carrier 15 was prepared.

Carrier Preparation Comparative Example 2

The procedure for preparation of the carrier 1 in Carrier Preparation Example 1 was repeated except that the methacrylic copolymer 1 was replaced with the methacrylic copolymer 6 prepared above.

Thus, a carrier 16 was prepared.

Carrier Preparation Comparative Example 3

The procedure for preparation of the carrier 1 in Carrier Preparation Example 1 was repeated except that the added amount of the barium sulfate powder covered with oxygen-deficient tin oxide was changed from 80 parts to 30 parts.

Thus, a carrier 17 was prepared.

Carrier Preparation Comparative Example 4

The procedure for preparation of the carrier 1 in Carrier Preparation Example 1 was repeated except that the added amount of the barium sulfate powder covered with oxygen-deficient tin oxide was changed from 80 parts to 130 parts.

Thus, a carrier 18 was prepared.

Carrier Preparation Comparative Example 5

The procedure for preparation of the carrier 1 in Carrier Preparation Example 1 was repeated except that the barium sulfate powder covered with oxygen-deficient tin oxide was replaced with a titanium oxide powder coated with antimony-less tin oxide (EPW-4 from Mitsubishi Materials Corp.).

Thus, a carrier 19 was prepared.

Carrier Preparation Comparative Example 6

The procedure for preparation of the carrier 1 in Carrier Preparation Example 1 was repeated except that the heat treatment was not performed.

Thus, a carrier 20 was prepared.

Carrier Preparation Comparative Example 7

The procedure for preparation of the carrier 1 in Carrier Preparation Example 1 was repeated except that the temperature of the heat treatment was changed from 180° C. to 90° C.

Thus, a carrier 21 was prepared.

Carrier Preparation Comparative Example 8

The procedure for preparation of the carrier 1 in Carrier Preparation Example 1 was repeated except that the copolymer 1 was replaced with 30 parts of a 25% by weight solution of a methylsilicone resin having a weight average molecular weight of 15,000.

Thus, a carrier 22 was prepared.

Carrier Preparation Comparative Example 9

The procedure for preparation of the carrier 1 in Carrier Preparation Example 1 was repeated except that the temperature of the heat treatment was changed from 180° C. to 250° C.

Thus, a carrier 23 was prepared.

Carrier Preparation Comparative Example 10

The procedure for preparation of the carrier 1 in Carrier Preparation Example 1 was repeated except that the methacrylic copolymer 1 was replaced with the methacrylic copolymer 9 prepared above.

Thus, a carrier 24 was prepared.

Carrier Preparation Comparative Example 11

The procedure for preparation of the carrier 1 in Carrier Preparation Example 1 was repeated except that the methacrylic copolymer 1 was replaced with the methacrylic copolymer 10 prepared above.

Thus, a carrier 25 was prepared.

Carrier Preparation Example 15

The procedure for preparation of the carrier 1 in Carrier Preparation Example 1 was repeated except that the methacrylic copolymer 1 was replaced with the methacrylic copolymer 11 prepared above.

Thus, a carrier 26 was prepared.

Carrier Preparation Example 16

The procedure for preparation of the carrier 1 in Carrier Preparation Example 1 was repeated except that the methacrylic copolymer 1 was replaced with the methacrylic copolymer 12 prepared above.

Thus, a carrier 27 was prepared.

The carriers prepared above were evaluated by the following methods.

1. Weight Average Particle Diameter (PDc) of Core Material

The weight average particle diameter of a core material is measured using a particle size analyzer, MICROTRACK HRA9320-X100 from Nikkiso Co., Ltd.

2. Magnetization (M) at a Magnetic Field of 1 kOe

The magnetization of each carrier is measured by an instrument VSM-P7-15 from Toei Industry Co., Ltd. Specifically, about 0.15 g of a carrier is fed into a cell having an inner diameter of 2.4 mm and a height of 8.5 mm, and the magnetization of the carrier is measured by the instrument at a magnetic field of 1 kOe.

3. Volume Resistivity (R)

The volume resistivity is measured using a cell illustrated in FIG. 1. Specifically, a carrier 3 is contained in a cell 1, which is made of a fluorine-containing resin and which has electrodes 1*a* and 1*b*, wherein each of the electrodes 1*a* and 1*b* has a dimension of 2.5 cm×4 cm and the distance between the electrodes 1*a* and 1*b* is 0.2 cm. After the carrier is fed into the cell so as to overflow from the cell without applying a pressure to the carrier, the cell is tapped 10 times at a tapping speed of 30 times per minute, and a nonmagnetic flat blade is slid once along the upper surface of the cell to remove the projected portion of the carrier projected from the upper surface of the cell. Next, a DC voltage of 1,000V is applied between the electrodes 1*a* and 1*b*, and the resistance r (Ω) of the carrier at a time 30 seconds after start of application of the DC voltage is measured with an instrument, HIGH RESISTANCE METER 4329A from Hewlett-Packard Japan, Ltd. The volume resistivity R (Ω·cm) of the carrier is determined from the following equation (1)

$$R=r(2.5\times4)/0.2 \quad (1).$$

4. Average Thickness (h) of Resinous Portion of Cover Layer

The average thickness of the resinous portion of the cover layer is determined as follows. Specifically, the cross sections of carrier particles are observed with a transmission electron microscope (TEM) to determine thicknesses of 50 points of the resinous portions of the cover layer. In this regard, the thicknesses of only resinous portions present between a barium sulfate particle and the surface of the core material and resinous portions constituting the cover layer by itself are measured. Namely, in FIG. 4 illustrating an example of the cover layer, among thicknesses ha, hb, hc and hd, only the thicknesses ha and hd of resinous portions of the cover layer are measured.

The average thickness (h) (in units of micrometer) of the cover layer is determined by averaging the 50 thickness data thus obtained.

5. Volume Average Particle Diameter (D) of Barium Sulfate

The volume average particle diameter (D) of barium sulfate is determined by the following method.

At first, 30 ml of an aminosilane coupling agent (SH6020 from Dow Corning Toray Silicone Co., Ltd.), and 300 ml of toluene are fed into a juicing blender, and then 6.0 g of a carrier is fed thereinto. The mixture is agitated by the juicing blender for 3 minutes while the rotation speed dial of the juicing blender is set to a "low" level to prepare a dispersion. Next, a proper amount of the thus prepared dispersion is mixed with 500 ml of toluene in a 1-liter beaker to be diluted. The diluted dispersion is always agitated with a homogenizer until the measurement operation is completed. Next, the volume average particle diameter of the carrier in the diluted dispersion is measured by a super centrifugal automatic particle diameter distribution measuring instrument, CAPA-700 from Horiba Ltd. The measuring conditions are as follows.

Rotation speed: 2,000 rpm

Measurable maximum particle diameter: 2.0 μm

Measurable minimum particle diameter: 0.1 μm

Interval of particle diameter (i.e., width of one particle diameter range): 0.1 μm Viscosity of dispersing medium: 0.59 mPa·s Density of dispersing medium: 0.87 g/cm$^3$ Density of particle: Data of the true specific gravity of the carrier, which is determined using a dry automatic bulk density measuring instrument, MICROMERITICS GAS PYCNOMETER ACCUPYC 1330 from Shimadzu Corp., is input to the instrument CAPA-700.

6. Ba/Si Ratio

The ratio Ba/Si of the content of barium (Ba) to the content of silicon (Si) in a carrier is determined by X-ray photoelectron spectroscopy (XPS). The instrument used for determining the ratio Ba/Si and measuring conditions are as follows.

1. Instrument: AXIS-ULTRA from Kratos Analytical
2. Measuring conditions (1) Light source: Al (in combination with monochromator)

(2) Measurement power: 90 W (15 kV and 6 mA)

(3) Measurement region: 900×600 pmt (4) Pass energy: 160 eV (wide scan), 40 eV (narrow scan)

(5) Energy step: 1.0 eV (wide scan), 0.2 eV (narrow scan)

(6) Relative sensitivity coefficient: Relative sensitivity coefficients presented by Kratos Analytical are used.

(7) Magnet controller: OFF (because carrier is a magnetic material)

When measurements are performed, a carrier is contained in a cylindrical hole of a chip having a depth of 0.3 mm and a flat surface of the carrier is subjected to XPS. The instrument outputs amounts of all the elements included in the cover layer in units of atomic percent. The ratio Ba/Si is determined from the amounts of Ba and Si.

7. Analysis of Structure of Resin in the Cover Layer

The structure of the resin included in a cover layer is analyzed by the following method.

Specifically, the resin in a cover layer is dissolved in a solvent such as xylene, methyl ethyl ketone and chloroform, followed by filtering to obtain the filtrate. The filtrate is subjected to a GC-MS analysis to determine the structure of the resin.

The results are shown in Tables 1-1 and 1-2.

TABLE 1-1

| | Carrier No. | Weight average particle diameter of core material (μm) | Magnetization of carrier ($Am^2/kg$) | Volume resistivity of carrier (log R (Ω · cm) |
|---|---|---|---|---|
| Carrier Preparation Ex. 1 | 1 | 35.9 | 69 | 12.8 |
| Carrier Preparation Ex. 2 | 2 | 36.1 | 70 | 12.7 |
| Carrier Preparation Ex. 3 | 3 | 35.8 | 68 | 13.0 |
| Carrier Preparation Ex. 4 | 4 | 36.1 | 68 | 12.8 |
| Carrier Preparation Ex. 5 | 5 | 35.7 | 71 | 13.9 |
| Carrier Preparation Ex. 6 | 6 | 36.0 | 67 | 11.9 |
| Carrier Preparation Ex. 7 | 7 | 36.0 | 69 | 14.8 |
| Carrier Preparation Ex. 8 | 8 | 36.1 | 70 | 12.4 |
| Carrier Preparation Ex. 9 | 9 | 35.9 | 69 | 12.2 |
| Carrier Preparation Ex. 10 | 10 | 36.3 | 66 | 13.3 |
| Carrier Preparation Ex. 11 | 11 | 36.0 | 69 | 13.0 |
| Carrier Preparation Ex. 12 | 12 | 35.9 | 69 | 12.8 |
| Carrier Preparation Ex. 13 | 13 | 36.1 | 70 | 12.5 |
| Carrier Preparation Ex. 14 | 14 | 36.3 | 69 | 12.1 |
| Carrier Preparation Comp. Ex. 1 | 15 | 36.1 | 69 | 12.9 |
| Carrier Preparation Comp. Ex. 2 | 16 | 36.0 | 68 | 12.7 |
| Carrier Preparation Comp. Ex. 3 | 17 | 36.0 | 72 | 14.5 |
| Carrier Preparation Comp. Ex. 4 | 18 | 36.0 | 66 | 11.3 |
| Carrier Preparation Comp. Ex. 5 | 19 | 36.0 | 70 | 12.3 |
| Carrier Preparation Comp. Ex. 6 | 20 | 36.0 | 70 | 12.1 |
| Carrier Preparation Comp. Ex. 7 | 21 | 36.0 | 70 | 12.3 |
| Carrier Preparation Comp. Ex. 8 | 22 | 36.0 | 69 | 12.9 |
| Carrier Preparation Comp. Ex. 9 | 23 | 35.9 | 70 | 11.9 |

TABLE 1-1-continued

| | Carrier No. | Weight average particle diameter of core material (μm) | Magnetization of carrier ($Am^2/kg$) | Volume resistivity of carrier (log R (Ω · cm) |
|---|---|---|---|---|
| Carrier Preparation Comp. Ex. 10 | 24 | 36.2 | 69 | 12.9 |
| Carrier Preparation Comp. Ex. 11 | 25 | 36.1 | 69 | 13.1 |
| Carrier Preparation Ex. 15 | 26 | 36.1 | 69 | 12.7 |
| Carrier Preparation Ex. 16 | 27 | 36.0 | 68 | 12.5 |

TABLE 1-2

| | Carrier No. | Thickness of resinous portion of cover layer (h) (μm) | Particle diameter of barium sulfate (D) (μm) | D/h ratio | Ba/Si ratio |
|---|---|---|---|---|---|
| Carrier Preparation Ex. 1 | 1 | 0.20 | 0.31 | 1.55 | 0.058 |
| Carrier Preparation Ex. 2 | 2 | 0.20 | 0.31 | 1.55 | 0.063 |
| Carrier Preparation Ex. 3 | 3 | 0.21 | 0.31 | 1.48 | 0.041 |
| Carrier Preparation Ex. 4 | 4 | 0.20 | 0.31 | 1.55 | 0.078 |
| Carrier Preparation Ex. 5 | 5 | 0.22 | 0.31 | 1.41 | 0.014 |
| Carrier Preparation Ex. 6 | 6 | 0.24 | 0.31 | 1.29 | 0.079 |
| Carrier Preparation Ex. 7 | 7 | 0.22 | 0.10 | 0.45 | 0.076 |
| Carrier Preparation Ex. 8 | 8 | 0.20 | 0.31 | 1.55 | 0.057 |
| Carrier Preparation Ex. 9 | 9 | 0.20 | 0.31 | 1.55 | 0.060 |
| Carrier Preparation Ex. 10 | 10 | 0.32 | 0.31 | 0.97 | 0.043 |
| Carrier Preparation Ex. 11 | 11 | 0.20 | 0.31 | 1.55 | 0.055 |
| Carrier Preparation Ex. 12 | 12 | 0.20 | 0.31 | 1.55 | 0.077 |
| Carrier Preparation Ex. 13 | 13 | 0.20 | 0.31 | 1.55 | 0.058 |
| Carrier Preparation Ex. 14 | 14 | 0.21 | 0.31 | 1.48 | 0.056 |
| Carrier Preparation Comp. Ex. 1 | 15 | 0.21 | 0.31 | 1.48 | 0.037 |

TABLE 1-2-continued

| | Carrier No. | Thickness of resinous portion of cover layer (h) (μm) | Particle diameter of barium sulfate (D) (μm) | D/h ratio | Ba/Si ratio |
|---|---|---|---|---|---|
| Carrier Preparation Comp. Ex. 2 | 16 | 0.20 | 0.31 | 1.55 | 0.086 |
| Carrier Preparation Comp. Ex. 3 | 17 | 0.21 | 0.31 | 1.48 | 0.009 |
| Carrier Preparation Comp. Ex. 4 | 18 | 0.23 | 0.31 | 1.35 | 0.087 |
| Carrier Preparation Comp. Ex. 5 | 19 | 0.22 | 0.27 | 1.23 | 0 |
| Carrier Preparation Comp. Ex. 6 | 20 | 0.20 | 0.31 | 1.55 | 0.006 |
| Carrier Preparation Comp. Ex. 7 | 21 | 0.21 | 0.31 | 1.48 | 0.056 |
| Carrier Preparation Comp. Ex. 8 | 22 | 0.20 | 0.31 | 1.55 | 0.052 |
| Carrier Preparation Comp. Ex. 9 | 23 | 0.22 | 0.31 | 1.41 | 0.058 |
| Carrier Preparation Comp. Ex. 10 | 24 | 0.20 | 0.31 | 1.55 | 0.064 |
| Carrier Preparation Comp. Ex. 11 | 25 | 0.21 | 0.31 | 1.48 | 0.096 |
| Carrier Preparation Ex. 15 | 26 | 0.20 | 0.31 | 1.55 | 0.052 |
| Carrier Preparation Ex. 16 | 27 | 0.21 | 0.31 | 1.485 | 0.057 |

Toner Preparation Example

1. Preparation of Polyester Resin A

The following components were fed into a reaction vessel equipped with a thermometer, an agitator, a condenser and a nitrogen feed pipe to be mixed.

| | |
|---|---|
| Propylene oxide adduct of bisphenol A (having hydroxyl value of 320 mmKOH/g) | 443 parts |
| Diethylene glycol | 135 parts |
| Terephthalic acid | 422 parts |
| Dibutyltin oxide | 2.5 parts |

The mixture was heated to 200° C. to be reacted. When the acid value of the reaction product reached 10 mgKOH/g, the reaction was stopped. Thus, a polyester resin A was prepared. It was confirmed that the polyester resin A has a glass transition temperature of 63° C. and a peak number average molecular weight of 6,000.

2. Preparation of Polyester Resin B

The following components were fed into a reaction vessel equipped with a thermometer, an agitator, a condenser and a nitrogen feed pipe to be mixed.

| | |
|---|---|
| Propylene oxide adduct of bisphenol A (having hydroxyl value of 320 mmKOH/g) | 443 parts |
| Diethylene glycol | 135 parts |
| Terephthalic acid | 422 parts |
| Dibutyltin oxide | 2.5 parts |

The mixture was heated to 230° C. to be reacted. When the acid value of the reaction product reached 7 mgKOH/g, the reaction was stopped. Thus, a polyester resin B was prepared. It was confirmed that the polyester resin B has a glass transition temperature of 65° C. and a peak number average molecular weight of 16,000.

3. Preparation of Mother Toner

The following components were mixed for 3 minutes using a HENSCHEL MIXER mixer (HENSCHEL 20B from Mitsui Mining & Smelting Co., Ltd.) in which a rotor was rotated at a revolution of 1,500 rpm.

| | |
|---|---|
| Polyester resin A prepared above | 40 parts |
| Polyester resin B prepared above | 60 parts |
| Carnauba wax | 1 part |
| Carbon black (#44 from Mitsubishi Chemical Corp.) | 15 parts |

The mixture was kneaded using a single screw extruder, KO-KNEADER from Buss AG. The kneading conditions were as follows.

Preset temperature at entrance of the kneader: 100° C.

Preset temperature at exit of the kneader: 50° C.

Fed amount of mixture to be kneaded: 2 kg/hour

Thus, a kneaded toner component mixture A1 was prepared.

After being subjected to roll cooling, the kneaded toner component mixture A1 was pulverized using a pulverizer, followed by fine pulverization using an I-type mill (IDS-2 from Nippon Pneumatic Mfg. Co., Ltd.) using a flat collision plate, and classification using a classifier (132MP from Alpine AG.). The fine pulverization conditions were as follows.

Pressure of air: 6.8 atm/cm$^2$

Fed amount of mixture to be pulverized: 0.5 kg/hour

Thus, a mother toner 1 was prepared.

4. Addition of External Additive

The following components were mixed using a HENSCHEL MIXER mixer.

| | |
|---|---|
| Mother toner prepared above | 100 parts |
| Hydrophobized silica (R972 from Nippon Aerosil Co. ltd.) | 1.0 part |

Thus, a toner 1, which has an average particle diameter of 7.2 μm, was prepared.

Developer Preparation Examples 1-16 and Developer Preparation Comparative Examples 1-11

Ninety three (93) parts of each of the carriers 1-27 prepared above was mixed with 7.0 parts of the toner 1, and the mixture was subjected to ball milling for 20 minutes to prepare developers 1-27 for developing electrostatic images (i.e., developers of Developer Preparation Examples 1-16 and developers of Developer Preparation Comparative Examples 1-11).

The above-prepared developers 1-25 were evaluated as follows.

1. Charge Quantity (Q)

The initial charge quantity (Q1) of each of the developers 1-25 was measured with a blow-off type charge quantity measuring device (TB-200 from Toshiba Chemical Corp.).

Specifically, after a running test in which 100,000 copies of an A-4 size original image having an image area ratio of 40% are produced was performed using each developer and an image forming apparatus, IMAGIO NEO C600 from Ricoh Co., Ltd., the charge quantity (Q2) of the developer was also measured with the blow-off type charge quantity measuring device to determine the charge quantity difference |Q1−Q2|.

In this regard, the charge quantity difference |Q1−Q2| is preferably not greater than 10 μC/g. When the charge quantity decreases in an amount of greater than 10 μC/g, the background development problem and the toner scattering problem are often caused. By contrast, when the charge quantity increases in an amount of greater than 10 μC/g, the image density tends to decrease.

2. Volume Resistivity (R) and Background Development

The initial logarithmic volume resistivity (log R1) of each of the carriers 1-25 was measured by the method mentioned above.

After a running test in which 100,000 copies of an A-4 size original image having an image area ratio of 3% are produced was performed using each developer and an image forming apparatus, IMAGIO NEO C600 from Ricoh Co., Ltd., the logarithmic volume resistivity (log R2) of the carrier in the developer used for the running test was also measured to determine the logarithmic volume resistivity difference |(log R1)−(log R2)|.

In this regard, the volume resistivity difference |(log R1)−(log R2)| is preferably not greater than 1.5. When the volume resistivity decreases in an amount of greater 1.5 log Ω·cm, a carrier adhesion problem in that carrier particles adhere to a solid image, resulting in formation of white spot images is often caused. By contrast, when the volume resistivity increases in an amount of greater 1.5 log Ω·cm, carrier particles tend to adhere to edge portions of images, resulting in formation of half-tone images having white spots.

In addition, after the running test, a white image was produced using the image forming apparatus to determine whether the developer causes background development. Specifically, after an electrostatic latent image corresponding to a white image was developed and before the developed image is transferred to a recording sheet, the image forming apparatus was suddenly stopped, and toner particles present on a surface of the photoreceptor (which correspond to a white image portion) were transferred to an adhesive tape. The tape bearing toner particles thereon was attached to a white paper while a blank tape was also attached to the white paper, and the optical density (OD1) of the tape bearing toner images and the optical density (OD0) of the blank tape were measured with a spectrodensitometer 938 from X-Rite Inc. to determine the optical density difference |OD1−OD0|.

The background development property is graded as follows.

◎: The optical density difference |OD1−OD0| is less than 0.005. (excellent)

○: The optical density difference |OD1−OD0| is not less than 0.005 and less than 0.01. (good)

Δ: The optical density difference |OD1−OD0| is not less than 0.01 and less than 0.02. (acceptable)

X: The optical density difference |OD1−OD0| is greater than 0.02. (unusable)

3. Color Mixture

Before and after the 100,000-copy running test using the A-4 size original image having an image area ratio of 3%, a half tone image was formed on a recording paper TYPE 6000 from Ricoh Co., Ltd., and the color tone of the half tone image was measured using an L*a*b* color system to determine ΔE, which is defined as follows.

$$\Delta E=[(L^*1-L^*2)^2+(a^*1-a^*2)^2+(b^*1-b^*2)^2]^{1/2}$$

wherein L1*, a1* and b1* represent the lightness and color tones of the half tone image before the running test, and L2*, a2*, and b2* represent the lightness and color tones of the half tone image after the running test.

The color mixture property of the developers is graded as follows.

◎: ΔE is not less than 0 and less than 2. (excellent)

○: ΔE is not less than 2 and less than 3. (good)

Δ: ΔE is not less than 3 and less than 5. (acceptable)

X: ΔE is not less than 5. (unusable)

The evaluation results are shown in Table 2-1 and 2-2.

TABLE 2-1

| | Developer No. | Q1 (-μC/g) | Q2 (-μC/g) | Q1 − Q2 (-μC/g) |
|---|---|---|---|---|
| Developer Preparation Example 1 | 1 | 37 | 32 | 5 |
| Developer Preparation Example 2 | 2 | 40 | 35 | 5 |
| Developer Preparation Example 3 | 3 | 44 | 36 | 8 |
| Developer Preparation Example 4 | 4 | 35 | 27 | 8 |
| Developer Preparation Example 5 | 5 | 34 | 26 | 8 |
| Developer Preparation Example 6 | 6 | 45 | 42 | 3 |
| Developer Preparation Example 7 | 7 | 46 | 42 | 4 |
| Developer Preparation Example 8 | 8 | 34 | 29 | 5 |
| Developer Preparation Example 9 | 9 | 38 | 31 | 7 |
| Developer Preparation Example 10 | 10 | 38 | 34 | 4 |
| Developer Preparation Example 11 | 11 | 39 | 33 | 6 |
| Developer Preparation Example 12 | 12 | 38 | 31 | 7 |
| Developer Preparation Example 13 | 13 | 40 | 33 | 7 |
| Developer Preparation Example 14 | 14 | 34 | 25 | 9 |
| Developer Preparation Comparative Example 1 | 15 | 47 | 28 | 19 |
| Developer Preparation Comparative Example 2 | 16 | 38 | 20 | 18 |
| Developer Preparation Comparative Example 3 | 17 | 32 | 20 | 12 |

TABLE 2-1-continued

| | Developer No. | Q1 (-μC/g) | Q2 (-μC/g) | Q1 − Q2 (-μC/g) |
|---|---|---|---|---|
| Developer Preparation Comparative Example 4 | 18 | 52 | 51 | 1 |
| Developer Preparation Comparative Example 5 | 19 | 33 | 14 | 19 |
| Developer Preparation Comparative Example 6 | 20 | 30 | 23 | 7 |
| Developer Preparation Comparative Example 7 | 21 | 32 | 27 | 5 |
| Developer Preparation Comparative Example 8 | 22 | 33 | 44 | −11 |

TABLE 2-1-continued

| | Developer No. | Q1 (-μC/g) | Q2 (-μC/g) | Q1 − Q2 (-μC/g) |
|---|---|---|---|---|
| Developer Preparation Comparative Example 9 | 23 | 36 | 30 | 6 |
| Developer Preparation Comparative Example 10 | 24 | 39 | 28 | 11 |
| Developer Preparation Comparative Example 11 | 25 | 39 | 23 | 16 |
| Developer Preparation Example 15 | 26 | 40 | 35 | 5 |
| Developer Preparation Example 16 | 27 | 37 | 34 | 3 |

TABLE 2-2

| | Developer No. | log R1 (Ω · cm) | log R2 (Ω · cm) | log R1 (Ω · cm) − log R2 (Ω · cm) | Back-ground development | Color mixture |
|---|---|---|---|---|---|---|
| Developer Preparation Example 1 | 1 | 12.8 | 12.3 | 0.5 | ○ | ○ |
| Developer Preparation Example 2 | 2 | 12.7 | 12.0 | 0.7 | ○ | ○ |
| Developer Preparation Example 3 | 3 | 13.0 | 12.0 | 1.0 | ○ | ○ |
| Developer Preparation Example 4 | 4 | 12.8 | 13.5 | −0.7 | ○ | ○ |
| Developer Preparation Example 5 | 5 | 13.9 | 13.2 | 0.7 | ◎ | ○ |
| Developer Preparation Example 6 | 6 | 11.9 | 12.3 | −0.4 | ○ | ○ |
| Developer Preparation Example 7 | 7 | 14.8 | 14.4 | 0.4 | ○ | ○ |
| Developer Preparation Example 8 | 8 | 12.4 | 11.5 | 0.9 | ○ | ○ |
| Developer Preparation Example 9 | 9 | 12.2 | 11.8 | 0.4 | ○ | Δ |
| Developer Preparation Example 10 | 10 | 13.3 | 13.1 | 0.2 | ○ | ○ |
| Developer Preparation Example 11 | 11 | 13.0 | 12.2 | 0.8 | ○ | ○ |
| Developer Preparation Example 12 | 12 | 12.8 | 12.1 | 0.7 | ○ | ○ |
| Developer Preparation Example 13 | 13 | 12.5 | 11.9 | 0.6 | ○ | ○ |
| Developer Preparation Example 14 | 14 | 12.1 | 11.3 | 0.8 | ○ | ○ |
| Developer Preparation Comparative Example 1 | 15 | 12.9 | 11.0 | 1.9 | ○ | ○ |

TABLE 2-2-continued

| | Developer No. | log R1 (Ω · cm) | log R2 (Ω · cm) | log R1 (Ω · cm) − log R2 (Ω · cm) | Back-ground development | Color mixture |
|---|---|---|---|---|---|---|
| Developer Preparation Comparative Example 2 | 16 | 12.7 | 13.5 | −0.8 | Δ | ○ |
| Developer Preparation Comparative Example 3 | 17 | 14.5 | 13.4 | 1.1 | Δ | ○ |
| Developer Preparation Comparative Example 4 | 18 | 11.3 | 9.5 | 1.8 | Δ | Δ |
| Developer Preparation Comparative Example 5 | 19 | 12.3 | 11.7 | 0.6 | X | ○ |
| Developer Preparation Comparative Example 6 | 20 | 12.1 | 9.4 | 2.7 | Δ | ○ |
| Developer Preparation Comparative Example 7 | 21 | 12.3 | 10.1 | 2.2 | ○ | ○ |
| Developer Preparation Comparative Example 8 | 22 | 12.9 | 14.8 | 1.0 | ○ | ○ |
| Developer Preparation Comparative Example 9 | 23 | 11.9 | 10.6 | 1.3 | ○ | X |
| Developer Preparation Comparative Example 10 | 24 | 12.9 | 11.3 | 1.6 | Δ | ○ |
| Developer Preparation Comparative Example 11 | 25 | 13.1 | 11.1 | 2.0 | Δ | ○ |
| Developer Preparation Example 15 | 26 | 12.7 | 12.5 | 0.2 | ○ | ○ |
| Developer Preparation Example 16 | 27 | 12.5 | 12.2 | 0.3 | ○ | ○ |

It can be understood from Tables 2-1 and 2-2 that the carrier of the present invention has a good combination of background development property and color mixture property because the cover layer has good abrasion resistance and hardly causes the spent toner problem. Although the images produced by the developers 15 and 21, which are comparative developers, have no problem in this running test, the volume resistivities of the carriers of the developers 15 and 21 decrease in an amount of 1.9 and 2.2, respectively, which are greater than 1.5, and therefore the developers would produce images having white spots if the running test was continued. In addition, although the images produced by the developer 22, which is also a comparative developer, has no problem with respect to background development and color mixture, the charge quantity of the carrier of the developer 22 increases in an amount of 11 μC/g, which is greater than 10 μC/g, and therefore the images produced by the developer had low image densities.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2009-241702, 2009-238554, 2010-054494, and 2010-200242, filed on Oct. 20, 2009, Oct. 15, 2009, Mar. 11, 2010, and Sep. 7, 2010, respectively, the entire contents of which are herein incorporated by reference.

What is claimed is:

1. A carrier for use in a two-component developer for developing an electrostatic latent image, comprising:

a particulate magnetic core material; and a cover layer located on a surface of the core material and including a crosslinked material and barium sulfate, the cover layer being formed by applying a coating medium including barium sulfate, a copolymer including a unit (A) having the below-mentioned formula (1) and a unit (B) having the below-mentioned formula (2), and a condensation reaction catalyst to the surface of the core material, and heating the applied medium to a temperature of from 100° C. to 230° C. so that the copolymer is hydrolyzed to produce a material having a silanol group, the material and the condensation reaction catalyst are subjected to a condensation reaction to form the crosslinked material, (1)

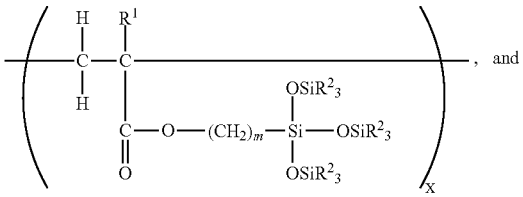

, and (2)

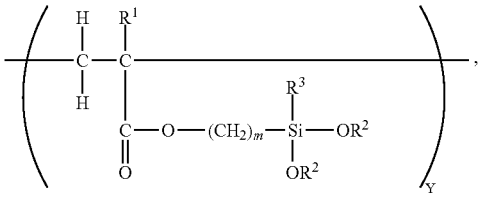

, wherein $R^1$ represents a hydrogen atom or a methyl group, m is an integer of from 1 to 8, $(CH_2)_m$ represents an alkylene group having 1 to 8 carbon atoms, $R^2$ represents an alkyl group having 1 to 4 carbon atoms, $R^3$ represents an alkyl group having 1 to 8 carbon atoms or an alkoxyl group having 1 to 4 carbon atoms, and X and Y respectively represent molar ratios of the units A and B and each of X and Y is from 10% by mole to 90% by mole, wherein the cover layer includes Ba and Si at an atomic ratio of from 0.01 to 0.08 as determined by X-ray photoelectron spectroscopy.

2. The carrier according to claim 1, wherein the copolymer has the following formula (5):

(5)

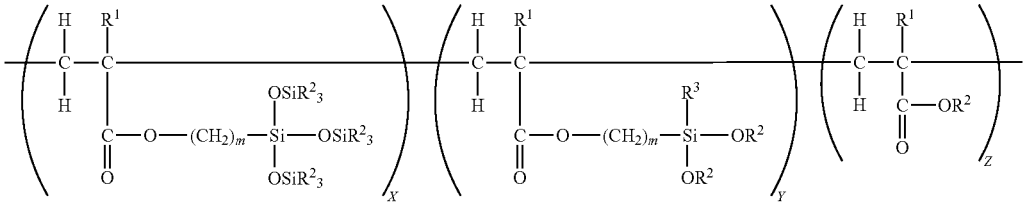

, wherein $R^1$ represents a hydrogen atom or a methyl group, m is an integer of from 1 to 8, $(CH_2)_m$ represents an alkylene group having 1 to 8 carbon atoms, $R^2$ represents an alkyl group having 1 to 4 carbon atoms, $R^3$ represents an alkyl group having 1 to 8 carbon atoms or an alkoxyl group having 1 to 4 carbon atoms, and X, Y and Z respectively represent molar ratios of the units A, B and C, and each of X and Y is from 10% by mole to 40% by mole and Z is from 30% by mole to 80% by mole, wherein 60% by mole<Y+Z<90% by mole.

3. The carrier according to claim 1, wherein the condensation reaction catalyst includes a titanium-containing complex catalyst.

4. The carrier according to claim 3, wherein the titanium-containing complex catalyst is titanium diisopropoxybis (ethylacetoacetate).

5. The carrier according to claim 1, wherein the carrier satisfies the following relation:

$$1.0<D/h<2.0,$$

wherein D represents a volume average particle diameter of barium sulfate, and h represents an average thickness of a resinous portion of the cover layer.

6. The carrier according to claim 1, wherein the cover layer includes a resinous portion having an average thickness (h) of from 0.05 μm to 4 μm.

7. The carrier according to claim 1, wherein the carrier has a logarithmic volume resistivity of from 9.0 log(Ω·cm) to 17.0 log(Ω·cm).

8. The carrier according to claim 1, wherein the core material has a weight average particle diameter of from 20 μm to 65 μm.

9. The carrier according to claim 1, wherein the carrier has a magnetization of from 40 $Am^2/kg$ to 90 $Am^2/kg$ at a magnetic field of 1 kOe.

10. A two-component developer for developing an electrostatic latent image, comprising:

the carrier according to claim 1; and a toner.

11. The two-component developer according to claim 10, wherein the toner is a color toner.

12. The two-component developer according to claim 10, used as a supplementary developer, wherein a weight ratio (C/T) of the carrier to the toner (T) is from 1/2 to 1/50.

13. An image forming method comprising:

forming an electrostatic latent image on an image bearing member;

developing the electrostatic latent image with the two-component developer according to claim 10 to form a toner image on the image bearing member;

transferring the toner image to a recording material; and fixing the toner image to the recording material.

14. A method for preparing a carrier, comprising:

applying a coating medium including barium sulfate, a copolymer including a unit (A) having the below-mentioned formula (1) and a unit (B) having the below-mentioned formula (2), and a condensation reaction catalyst to a particulate core material; and heating the applied medium to a temperature of from 100° C. to 230° C. so that the copolymer is hydrolyzed to produce a material having a silanol group, and the material and the condensation reaction catalyst are subjected to a condensation reaction to form a cover layer including a crosslinked material and barium sulfate on a surface of the particulate core material, (1)

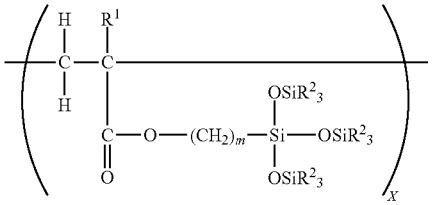

, and

-continued (2)

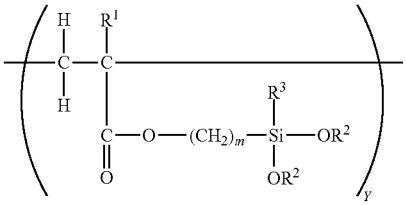

, wherein $R^1$ represents a hydrogen atom or a methyl group, m is an integer of from 1 to 8, $(CH_2)_m$ represents an alkylene group having 1 to 8 carbon atoms, $R^2$ represents an alkyl group having 1 to 4 carbon atoms, $R^3$ represents an alkyl group having 1 to 8 carbon atoms or an alkoxyl group having 1 to 4 carbon atoms, and X and Y respectively represent molar ratios of the units A and B and each of X and Y is from 10% by mole to 90% by mole.

15. The carrier preparation method according to claim 14, wherein the copolymer has the following formula (5):

(5)

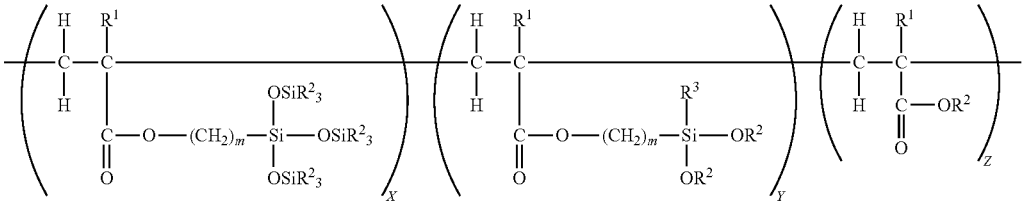

, wherein $R^1$ represents a hydrogen atom or a methyl group, m is an integer of from 1 to 8, $(CH_2)_m$ represents an alkylene group having 1 to 8 carbon atoms, $R^2$ represents an alkyl group having 1 to 4 carbon atoms, $R^3$ represents an alkyl group having 1 to 8 carbon atoms or an alkoxyl group having 1 to 4 carbon atoms, and X, Y and Z respectively represent molar ratios of the units A, B and C, and each of X and Y is from 10% by mole to 40% by mole and Z is from 30% by mole to 80% by mole, wherein 60% by mole<Y+Z<90% by mole.

* * * * *